US011760533B2

(12) United States Patent
Oliveira

(10) Patent No.: US 11,760,533 B2
(45) Date of Patent: Sep. 19, 2023

(54) CARTON FOR ARTICLES

(71) Applicant: Graphic Packaging International, LLC, Atlanta, GA (US)

(72) Inventor: Steven M. Oliveira, Canton, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 27 days.

(21) Appl. No.: 17/128,555

(22) Filed: Dec. 21, 2020

(65) Prior Publication Data

US 2021/0188478 A1 Jun. 24, 2021

Related U.S. Application Data

(60) Provisional application No. 62/952,728, filed on Dec. 23, 2019.

(51) Int. Cl.
*B65D 5/54* (2006.01)
*A45D 27/22* (2006.01)

(52) U.S. Cl.
CPC ..... *B65D 5/5495* (2013.01); *A45D 27/225* (2013.01); *B65D 2571/0066* (2013.01); *B65D 2571/00141* (2013.01)

(58) Field of Classification Search
CPC ..... B65D 5/5495; B65D 2571/00864; B65D 5/0085; B65D 5/009; B65D 75/42; A45D 27/225
USPC ..... 229/120.011, 120.18, 120.03, 120.08, 229/120.09, 120.01, 120.11; 206/192, 206/256, 264, 736, 747, 268; 426/108
See application file for complete search history.

(56) References Cited

U.S. PATENT DOCUMENTS

| | | | |
|---|---|---|---|
| 732,844 | A | 7/1903 | Gerbereux |
| 1,662,028 | A | 3/1928 | Gold et al. |
| 1,824,491 | A | 9/1931 | Molins |

(Continued)

FOREIGN PATENT DOCUMENTS

| | | | |
|---|---|---|---|
| CN | 104670614 | A | 6/2015 |
| EP | 0 639 504 | | 2/1995 |

(Continued)

OTHER PUBLICATIONS

International Search Report and Written Opinion for PCT/US2020/066329 dated Apr. 9, 2021.

*Primary Examiner* — Christopher R Demeree
(74) *Attorney, Agent, or Firm* — WOMBLE BOND DICKINSON (US) LLP

(57) ABSTRACT

A carton for holding a plurality of articles. The carton can comprise a plurality of panels comprising a back panel, a first front panel positioned opposite to the back panel, and a second front panel positioned opposite to the back panel. The carton can comprise a first compartment comprising a first interior space for at least partially receiving at least a first article of the plurality of articles and a second compartment comprising a second interior space for at least partially receiving at least a second article of the plurality of articles. At least a portion of at least the back panel and the first front panel can extend at least partially around the first interior space of the first compartment. At least a portion of at least the back panel and the second front panel can extend at least partially around the second interior space of the second compartment.

41 Claims, 20 Drawing Sheets

(56) References Cited

U.S. PATENT DOCUMENTS 1,883,852 A 10/1932 Medoff
2,046,484 A * 7/1936 Ringler ..... B65D 5/5495 206/256
2,162,094 A 6/1939 Mahone
D115,651 S 7/1939 Ford et al.
D120,673 S 5/1940 Jung
2,263,191 A * 11/1941 Saladin ..... B65D 75/20 206/800
2,348,378 A 5/1944 Goodyear
2,586,301 A 2/1952 Castle
2,794,585 A 6/1957 Wagner
3,013,710 A 12/1961 Kronson et al.
3,039,671 A * 6/1962 Efthem ..... B65D 5/48002 206/256
3,158,312 A * 11/1964 Simkins ..... B65D 5/5495 229/120.011
3,257,027 A 6/1966 Weiss
3,640,380 A 2/1972 Huffman
3,835,987 A * 9/1974 Growney ..... B65D 5/50 206/769
D242,901 S 1/1977 Lohrbach
4,007,869 A 2/1977 Stolkin et al.
4,228,945 A 10/1980 Wysocki
4,238,069 A 12/1980 Morris, Jr.
4,397,393 A 8/1983 Pergande et al.
4,530,459 A 7/1985 Maroszek
4,601,390 A 7/1986 Rosenthal et al.
4,919,269 A * 4/1990 Wright ..... B65D 5/48014 229/120.08
D319,388 S 8/1991 McIntosh, Jr. et al.
5,123,589 A 6/1992 Cote
5,299,734 A 4/1994 Lane
5,400,901 A 3/1995 Harrelson
5,501,335 A 3/1996 Harris
5,524,814 A 6/1996 Davis
5,540,333 A 7/1996 Gonzalez et al.
D373,079 S 8/1996 Fahlen
5,551,556 A 9/1996 Sutherland
5,595,291 A 1/1997 Negelen
D386,680 S 11/1997 Johnson
5,950,912 A 9/1999 Economopoulos
6,012,630 A * 1/2000 Block ..... B65D 5/48004 206/192
6,102,197 A 8/2000 Negelen
6,439,452 B1 8/2002 Tsao
6,491,164 B1 * 12/2002 Virvo ..... B65D 25/36 40/604
6,530,516 B1 3/2003 Ritter
7,159,717 B2 1/2007 Aldridge et al.
D540,668 S 4/2007 Aldridge
7,476,830 B2 1/2009 Middleton et al.
7,569,008 B2 8/2009 Aldridge et al.
7,617,969 B2 11/2009 Oliveira
7,686,165 B2 3/2010 Aldridge et al.
7,793,780 B2 9/2010 Smalley
RE43,304 E * 4/2012 Zanaletti ..... D9/422
8,365,980 B2 2/2013 Wettlaufer et al.
8,534,538 B2 9/2013 Fitzwater
8,584,884 B2 11/2013 Learn et al.
8,784,916 B2 * 7/2014 Zotter ..... B65D 71/066 426/106
9,315,288 B2 4/2016 Pinkstone
D766,108 S 9/2016 Brown et al.
10,017,310 B2 * 7/2018 Lyzenga ..... B65D 75/585
10,106,291 B2 10/2018 Kearns
10,124,946 B2 * 11/2018 Lyzenga ..... B65B 7/08
10,329,049 B2 * 6/2019 Learn ..... B65D 5/48002
D865,515 S * 11/2019 McKenzie ..... D9/414
11,174,074 B2 * 11/2021 Safarik ..... B65D 25/00
2001/0030228 A1 10/2001 Todjar-Hengami
2003/0213705 A1 11/2003 Woog
2006/0016863 A1 1/2006 Holt et al.
2006/0091190 A1 5/2006 Nikolai
2007/0051784 A1 3/2007 Money et al.
2008/0197178 A1 8/2008 Aldridge et al.
2008/0264812 A1 10/2008 Gonzalez
2011/0180593 A1 7/2011 Wettlaufer et al.
2015/0225158 A1 8/2015 Lyzenga et al.

FOREIGN PATENT DOCUMENTS

GB 889 718 2/1962
JP 10-086936 A 4/1998
JP 2000-203581 A 7/2000
JP 3138707 U 1/2008
KR 20-0115382 4/1998
KR 20-0245659 Y1 10/2001
KR 20-0255741 Y1 12/2001
KR 10-0336431 5/2002
KR 10-0856067 9/2008
KR 10-2012-0097923 A 9/2012
SE 140 388 5/1953
WO WO 00-76877 A1 12/2000
WO WO 2018/236299 12/2018

* cited by examiner

CARTON FOR ARTICLES

CROSS-REFERENCE TO RELATED APPLICATIONS

This application claims the benefit of U.S. Provisional Patent Application No. 62/952,728, filed on Dec. 23, 2019.

INCORPORATION BY REFERENCE

The disclosure of U.S. Provisional Patent Application No. 62/952,728, filed on Dec. 23, 2019, is hereby incorporated by reference for all purposes as if presented herein in its entirety.

BACKGROUND OF THE DISCLOSURE

The present disclosure generally relates to packages for receiving and/or holding articles and to methods of forming and using the packages. More specifically, the present disclosure is directed to a package including compartments for holding respective articles.

SUMMARY OF THE DISCLOSURE

In general, one aspect of the disclosure is generally directed to a carton for holding a plurality of articles. The carton can comprise a plurality of panels comprising a back panel, a first front panel positioned opposite to the back panel, and a second front panel positioned opposite to the back panel. The carton further can comprise a first compartment comprising a first interior space for at least partially receiving at least a first article of the plurality of articles and a second compartment comprising a second interior space for at least partially receiving at least a second article of the plurality of articles. At least a portion of at least the back panel and the first front panel can extend at least partially around the first interior space of the first compartment. At least a portion of at least the back panel and the second front panel can extend at least partially around the second interior space of the second compartment.

In another aspect, the disclosure is generally directed to a blank for forming a container for holding a plurality of articles. The blank can comprise a plurality of panels comprising a back panel, a first front panel, and a second front panel. At least a portion of at least the back panel and the first front panel can be for extending at least partially around a first interior space of a first compartment when the carton is formed from the blank, and the first interior space can be for at least partially receiving at least a first article of the plurality of articles when the carton is formed from the blank. At least a portion of at least the back panel and the second front panel can be for extending at least partially around a second interior space of a second compartment when the carton is formed from the blank, and the second interior space can be for at least partially receiving at least a second article of the plurality of articles when the carton is formed from the blank.

In another aspect, the disclosure is generally directed to a method of forming a package for holding a plurality of articles. The method can comprise obtaining a blank comprising a plurality of panels comprising a back panel, a first front panel, and a second front panel and positioning the plurality of panels to form at least a first compartment and a second compartment. The first compartment can comprise a first interior space for at least partially receiving at least a first article of the plurality of articles and the second compartment can comprise a second interior space for at least partially receiving at least a second article of the plurality of articles. At least a portion of at least the back panel and the first front panel can extend at least partially around the first interior space of the first compartment, and at least a portion of at least the back panel and the second front panel can extend at least partially around the second interior space of the second compartment.

Other aspects, features, and details of the present disclosure can be more completely understood by reference to the following detailed description of exemplary embodiment taken in conjunction with the drawings and from the appended claims.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to a carton for receiving and/or holding products to form a package. Cartons according to the present disclosure can accommodate articles of any shape. The carton can be of varying widths and can form multiple compartments in the interior of the carton. In some embodiments, the carton can enclose the compartments in the interior of the carton. In some embodiments the compartments of the carton can be configured for receiving and/or holding articles that are sent to a consumer. The articles can be made from materials suitable in composition for packaging the particular product, and the materials include, but are not limited to, paper materials, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes packages of razor cartridges and printed articles (e.g., pamphlets, booklets, flyers, cards, etc.) as disposed within the carton embodiments. In this specification, the terms "inner," "interior," "outer," "exterior," "lower," "bottom," "upper," and "top" indicate orientations determined in relation to fully erected and upright cartons.

Figure 1:
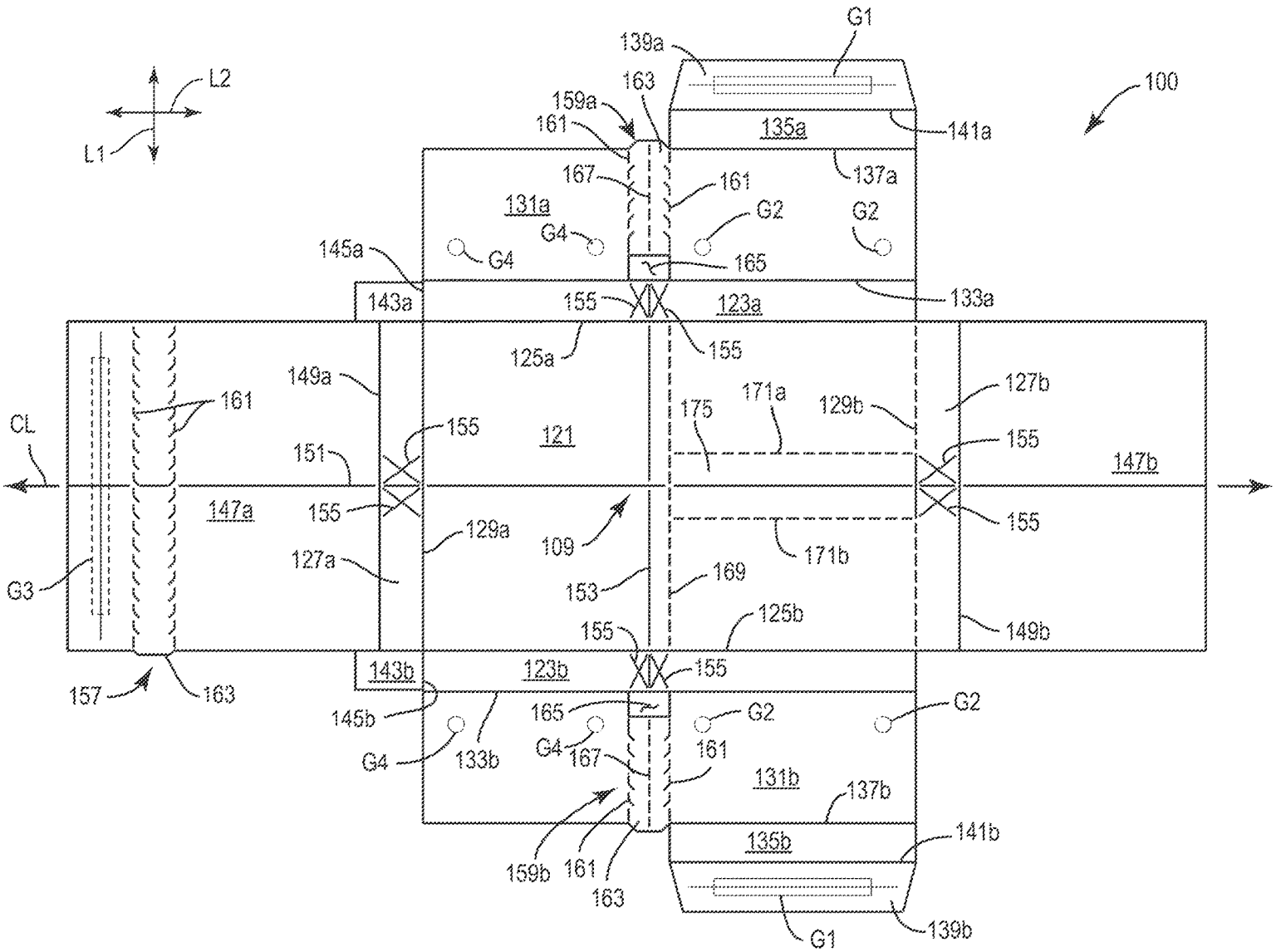
FIG. 1 is an interior plan view of a blank used to form a carton of a package according to a first exemplary embodiment of the disclosure.

FIG. 1 illustrates a blank 100 for forming a carton generally indicated at 101 (FIGS. 5, 8A, and 8B) according to a first exemplary embodiment of the disclosure. The carton 101 can be used to house a plurality of articles such as containers C and/or a printed article P (FIGS. 3A-4 and 7) in respective compartments 103, 105 (FIGS. 2-4, 6B, and 7). In one embodiment, the containers C can be rectangular (e.g., substantially rectangular or generally rectangular trays), each with a plurality of slots holding respective replacement razor cartridges for a cartridge razor system. Alternatively, the containers C could have any suitable shape or configuration for holding any suitable product. In one embodiment, the printed article P can include pamphlets, booklets, flyers, cards, and/or other suitable materials. The carton 101 could be configured for receiving any suitable number of the containers C and/or printed articles P in any suitable combination. In some embodiments, a package 107 including the carton and the articles (e.g., the containers C and/or printed articles P) held therein, can at least partially comply with particular United States Postal Service's mailing standards such as for packages intended for automated processing (e.g., automation flats, flat-size mailpieces, etc.) and/or other shipping and/or storage standards and/or requirements. For example, the carton 101 can include axial flexibility features 109 for allowing the package 107 to bend and/or flex a certain degree when passing through the U.S. Postal Services sorting machinery. In addition, in some embodiments, the carton 101 can include opening features 111 (FIGS. 5-6B) for dispensing the articles and/or for separating the compartments 103, 105 from one another.

As shown in FIG. 1, the blank 100 has a lateral axis L1 and a longitudinal axis L2. In the illustrated embodiment, the blank 100 has a back panel 121 foldably connected to a first side panel 123*a* along a longitudinal fold line 125*a* and a second side panel 123*b* along a longitudinal fold line 125*b*. A first end panel 127*a* is foldably connected to the back panel 121 along a lateral fold line 129*a* and a second end panel 127*b* is foldably connected to the back panel 121 along a lateral fold line 129*b*. As shown in FIG. 1, the blank 100 has a first front panel 131*a* foldably connected to the first side panel 123*a* along a longitudinal fold line 133*a* and a second front panel 131*b* foldably connected to the second side panel 123*b* along a longitudinal fold line 133*b*. A first divider panel 135*a* can be foldably connected to the first front panel 131*a* along a longitudinal fold line 137*a* and a first attachment flap 139*a* can be foldably connected to the first divider panel 135*a* along a longitudinal fold line 141*a*. A second divider panel 135*b* can be foldably connected to the second front panel 131*b* along a longitudinal fold line 137*b* and a second attachment flap 139*b* can be foldably connected to the second divider panel 135*b* along a longitudinal fold line 141*b*. In one embodiment, end flaps 143*a*, 143*b* can be foldably connected to respective ends of the respective side panels 123*a*, 123*b* along respective lateral fold lines 145*a*, 145*b* adjacent the first end panel 127*a*.

In the illustrated embodiment, the blank 100 can have a first cover panel 147*a* foldably connected to the first end panel 127*a* along a lateral fold line 149*a* and a second cover panel 147*b* foldably connected to the second end panel 127*b* along a lateral fold line 149*b*. Any of the back panel 121, the side panels 123*a*, 123*b*, the end panels 127*a*, 127*b*, the front panels 131*a*, 131*b*, the divider panels 135*a*, 135*b*, the attachment flaps 139*a*, 139*b*, the end flaps 143*a*, 143*b*, and/or the cover panels 147*a*, 147*b* could be omitted or could be otherwise arranged, shaped, positioned, and/or configured without departing from the disclosure.

As shown in FIG. 1, the flexibility features 109 can include a longitudinal score 151 extending along a longitudinal axis of the blank 100. In one embodiment, the longitudinal axis of the blank 100 can be a centerline CL of the blank 100. In one embodiment, the longitudinal score 151 can extend along the back panel 121, the end panels 127*a*, 127*b*, and the cover panels 147*a*, 147*b* and can be equidistant (e.g., approximately equidistant, substantially equidistant, generally equidistant, etc.) from the longitudinal fold lines 125*a*, 125*b*. In the illustrated embodiment, the flexibility features 109 further can include a lateral score 153 extending along a lateral axis of the blank 100. In an exemplary embodiment, the lateral score 153 can extend along the back panel 121 and the side panels 123*a*, 123*b*. As shown in FIG. 1, the flexibility features 109 further can include a pair of intersecting oblique scores 155 (e.g., in the form of an "X") on either side of the scores 151, 153 in the side panels 123*a*, 123*b* and the end panels 127*a*, 127*b*. In the illustrated embodiment, the scores 151, 153 can be broken (e.g., can include gaps) where they cross fold lines and other features in the blank 100. Alternatively, the scores could be continuous. Any of the flexibility features 109, including the scores 151, 153, 155, could be omitted or could be otherwise arranged, shaped, positioned, and/or configured without departing from the disclosure.

As shown in FIG. 1, the blank 100 can include features for forming the opening features 111 in the carton 101. In the illustrated embodiment, a tear strip 157 extends in the first cover panel 147*a* and tear strips 159*a*, 159*b* extend in the respective front panels 131*a*, 131*b*. The tear strips 157, 159*a*, 159*b* can be defined by respective pairs of tear lines 161 extending in the respective first cover panel 147*a* and front panels 131*a*, 131*b* in the lateral direction L1 and can have respective start tabs 163. In one embodiment, the front panels 131*a*, 131*b* can include respective cutouts 165 and the tear strips 159*a*, 159*b* can be spaced from the respective side panels 123*a*, 123*b* by the respective cutouts 165. As shown in FIG. 1, the tear strips 159*a*, 159*b* can include fold lines 167 that are aligned with the score 153 and can be considered extensions of the score 153 in some embodiments.

In the illustrated embodiment, the opening features 111 also can include tear lines or perforations for facilitating the separation of the compartments 103, 105 from one another and/or from a remainder of the carton 101 as described in more detail below. As shown in FIG. 1, the opening features 111 can include a lateral tear line 169 and two longitudinal tear lines 171*a*, 171*b* extending in the back panel 121. In one embodiment, the lateral tear line 169 can be spaced from the score 153 and can extend from the longitudinal fold line 125*a* to the longitudinal fold line 125*b*. In one example, the lateral tear line 169 can be aligned (e.g., substantially aligned or generally aligned) with tear lines 161 of the tear strips 159*a*, 159*b* in the front panels 131*a*, 131*b*. As shown in FIG. 1, the longitudinal tear lines 171*a*, 171*b* can be spaced apart from the score 151 and can extend from the lateral tear line 169 to the lateral fold line 129*b*. In addition to the tear lines 169, 171*a*, 171*b*, the lateral fold line 129*b* can be a tear line for separating the second end panel 127*b* and the second cover panel 147*b* from the compartments 103 as described in more detail below. The opening features, including any of the tear strips 157, 159*a*, 159*b*, the tear lines 169, 171*a*, 171*b*, and/or the tear line/fold line 129*b*, could be omitted or could be otherwise arranged, shaped, positioned, and/or configured without departing from the disclosure.

Figure 2:
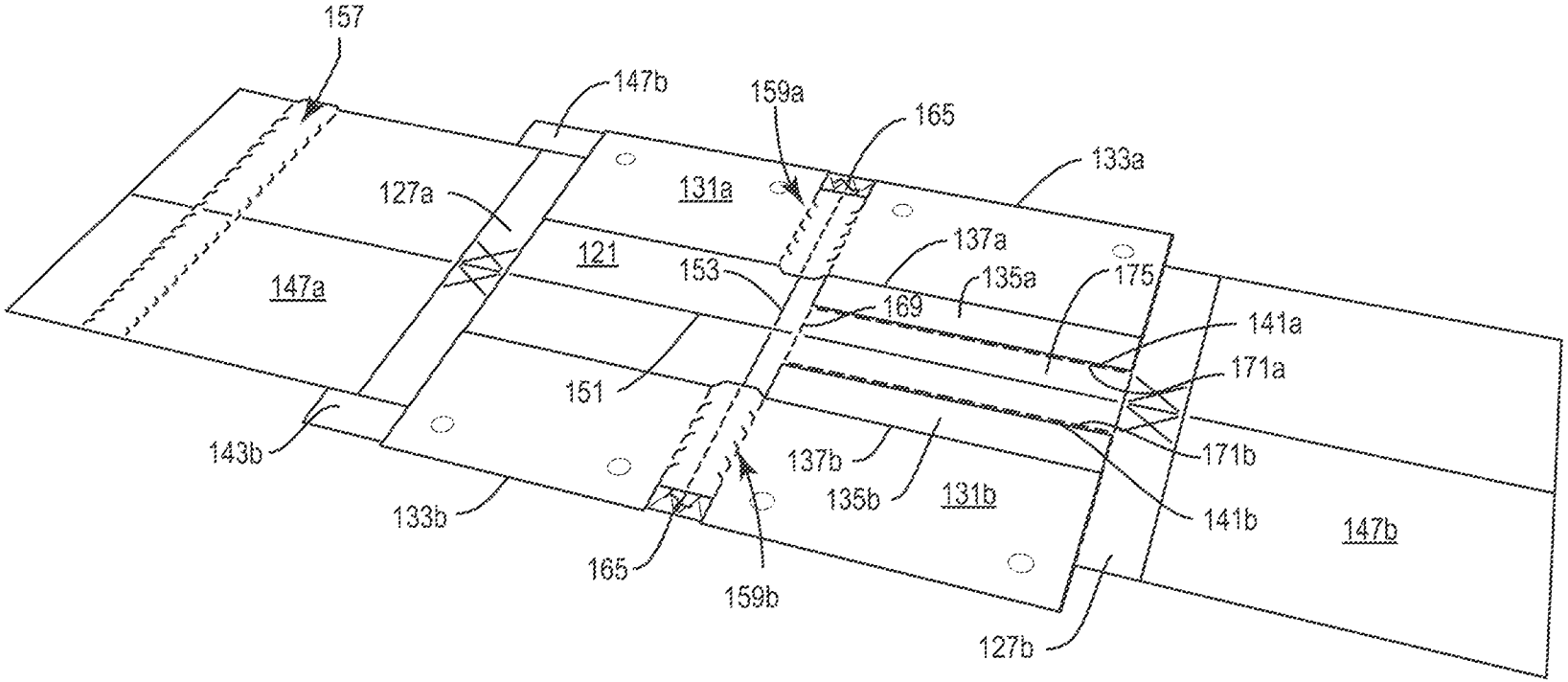
FIG. 2 is a perspective view of a partially-formed carton formed from the blank of FIG. 1 according to the first exemplary embodiment of the disclosure.

In the illustrated embodiment, the package 107 can be formed as shown in FIGS. 2-5. In one embodiment, the blank 100 can be positioned with the coated and/or printed (e.g., clay-coated side) facing upwardly, and the blank 100 can be folded along at least the longitudinal fold lines 133*a*, 133*b*, 141*a*, 141*b* to overlap the back panel 121 and the side panels 123*a*, 123*b* with the front panels 131*a*, 131*b* and the divider panels 135*a*, 135*b* and to position the attachment flaps 139*a*, 139*b* between the back panel 121 and the respective front panels 131*a*, 131*b* as shown in FIG. 2. In the illustrated embodiment, glue (e.g., in the form of glue strips G1 shown schematically in FIG. 1) can be applied to the attachment flaps 139*a*, 139*b* and/or the back panel 121 (e.g., prior to folding the blank 100) so that the attachment flaps 139*a*, 139*b* are glued to the back panel 121 when the attachment flaps 139*a*, 139*b* are positioned in face-to-face contact with the back panel 121 (FIG. 2). As shown in FIG. 2, the fold lines 141*a*, 141*b* can extend along (e.g., in contact with, adjacent, and/or proximate to) the longitudinal tear lines 171*a*, 171*b* when the attachment flaps 139*a*, 139*b* are glued to the back panel 121.

Figure 3A:
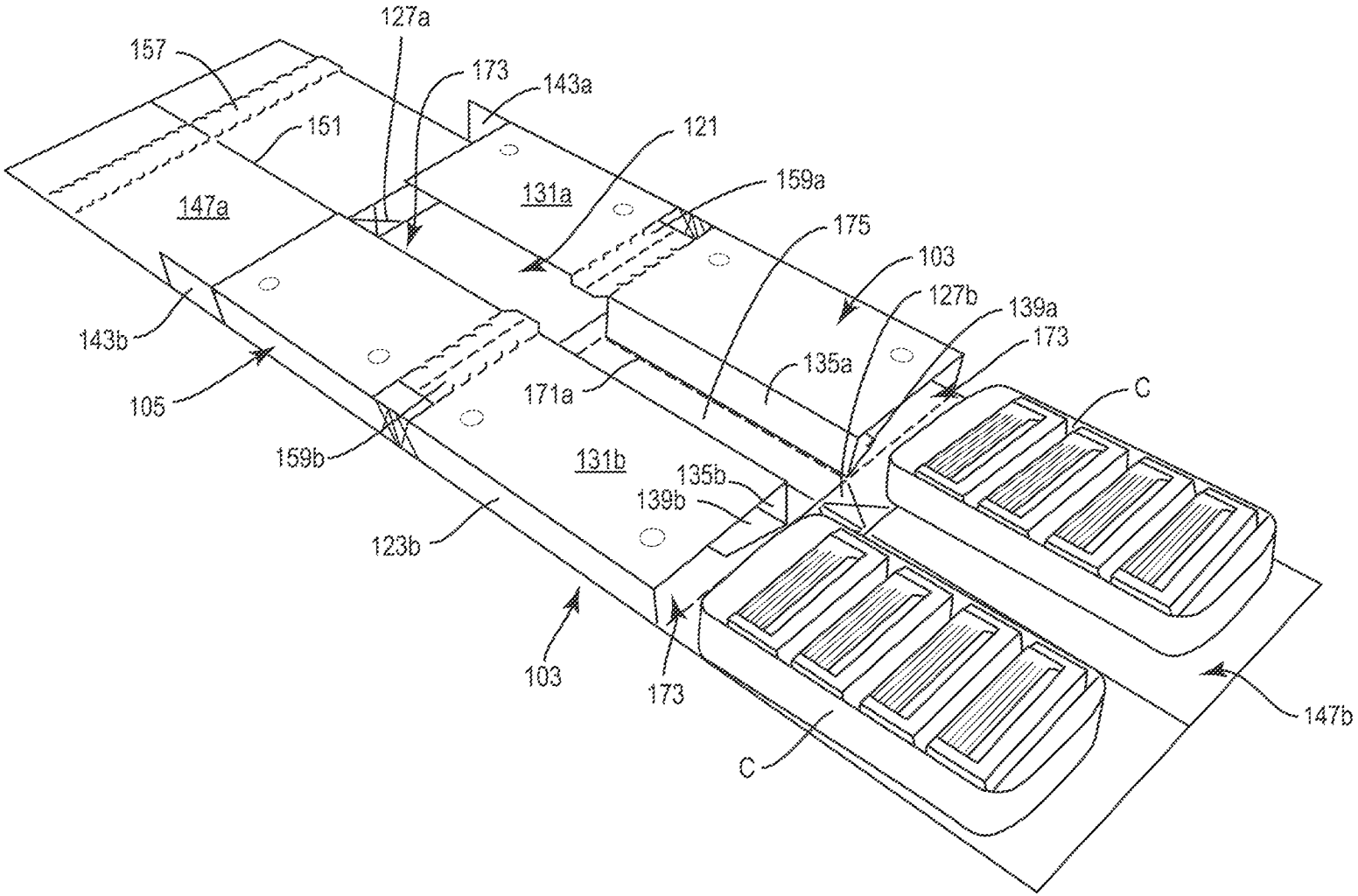
FIGS. 3A and 3B are perspective views showing the loading of articles into the partially-formed carton of FIG. 2 according to the first exemplary embodiment of the disclosure.
Figure 3B:
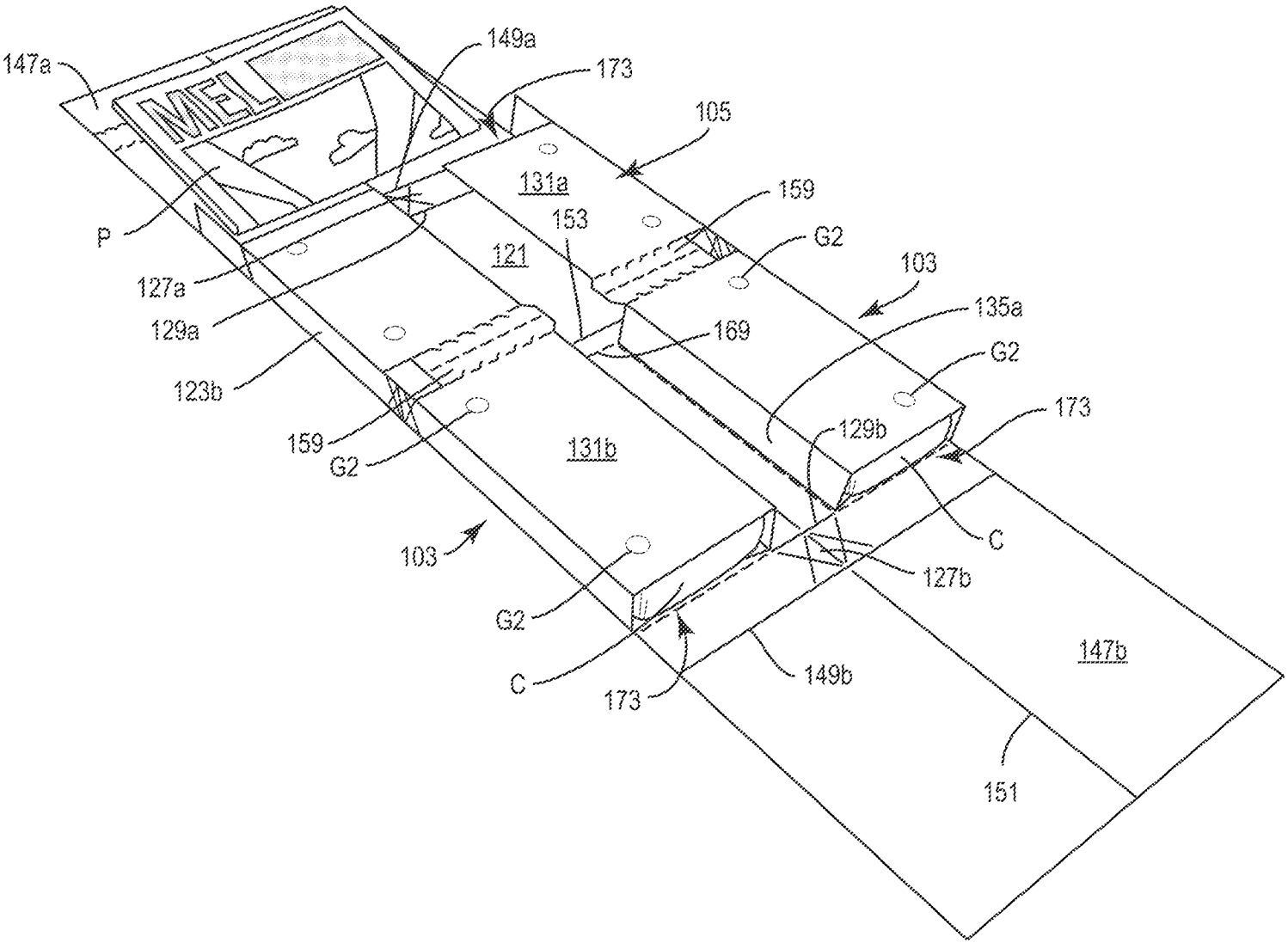

As shown in FIGS. 3A and 3B, the side panels 123*a*, 123*b*, the front panels 131*a*, 131*b*, and the divider panels 135*a*, 135*b* can be folded along the longitudinal fold lines 125*a*, 125*b*, 133*a*, 133*b*, 137*a*, 137*b*, 141*a*, 141*b* to at least partially form the compartments 103, 105 with portions of the panels 121, 123*a*, 123*b*, 131*a*, 131*b*, 135*a*, 135*b* and the attachment flaps 139*a*, 139*b* extending around respective interior spaces 173 of the respective compartments 103, 105. For example, a portion of the first side panel 123*a*, a section of the first front panel 131*a* defined by the tear strip 159*a*, the first divider panel 135*a*, the first attachment flap 139*a*, and a section of the back panel 121 defined by the lateral tear line 169, the longitudinal tear line 171*a*, and the fold lines 125*a*, 129*b* extend along the interior space 173 of one of the compartments 103 (e.g., the first interior space of the first compartment). Similarly, a portion of the second side panel 123*b*, a section of the second front panel 131*b* defined by the tear strip 159*b*, the second divider panel 135*b*, the second attachment flap 139*b*, and a section of the back panel 121 defined by the lateral tear line 169, the longitudinal tear line 171*b*, and the fold lines 125*b*, 129*b* extend along the interior space 173 of the other one of the compartments 103 (e.g., the second interior space of the second compartment). In the illustrated embodiment, a tear-away section 175 of the back panel 121 can be defined by the tear lines 169, 171*a*, 171*b*, 129*b* extending between the compartments 103. In addition, portions of the side panels 123*a*, 123*b*, sections of the front panels 131*a*, 131*b* defined by the respective tear strips 159*a*, 159*b*, and a section of the back panel 121 defined by the lateral tear line 169 and the fold lines 125*a*, 125*b*, 129*a* can extend along the interior space 173 of the compartment 105 (e.g., the third interior space of the third compartment). The compartments 103, 105 could be otherwise formed and/or could be otherwise arranged, shaped, positioned, and/or configured without departing from the disclosure.

Figure 4:
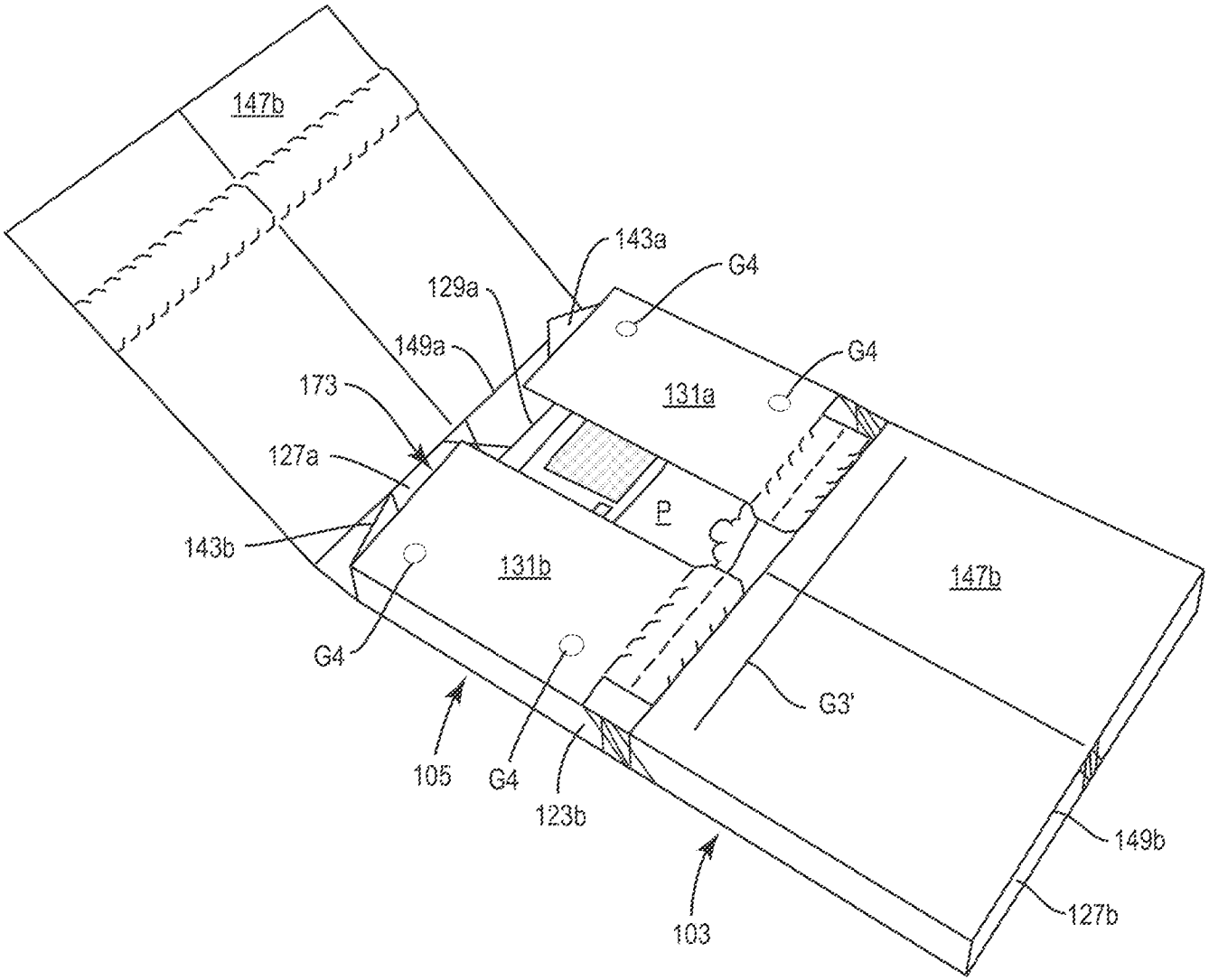
FIG. 4 is a perspective view showing the closing of the carton according to the first exemplary embodiment of the disclosure.

As shown in FIGS. 3A and 3B, the articles C, P can be loaded into the interior spaces 173 of the respective compartments 103, 105. In the illustrated embodiment, the containers C can be inserted into the interior spaces 173 of the respective compartments 103. In one embodiment, the containers C can fit tightly in the compartments 103 to help prevent the containers C from unintentionally sliding out of the compartments 103 but allowing the containers C to be pushed into or pulled out of the compartments 103. As shown in FIG. 3B, the entire container C fits in the interior space 173 of the compartment 103 (e.g., from the opening of the compartment 103 adjacent the fold line 129*b* to the tear strip 159*a*, 159*b*); however, in alternative embodiments, portions of the containers C can extend outside the compartment 103. The printed article P can be at least partially inserted into the interior space 173 of the compartment 105 as shown in FIGS. 3B and 4. In one embodiment, the width of the carton 101 can be at least partially determined by the width of the printed article P, and the carton 101 could be narrower for a smaller printed article P, which could bring the compartments 103 closer together and reduce the size of or eliminate the tear-away section 175. In some embodiments, the width of the carton 101 can also be at least partially configured for allowing a suitable amount of bending of the carton 101 (e.g., at the flexibility features 109). For example, the spacing of the compartments 103 can facilitate bending of the carton 101. The articles C, P could be otherwise loaded into the compartments 103, 105 in any suitable order or simultaneously without departing from the disclosure.

Figure 5:
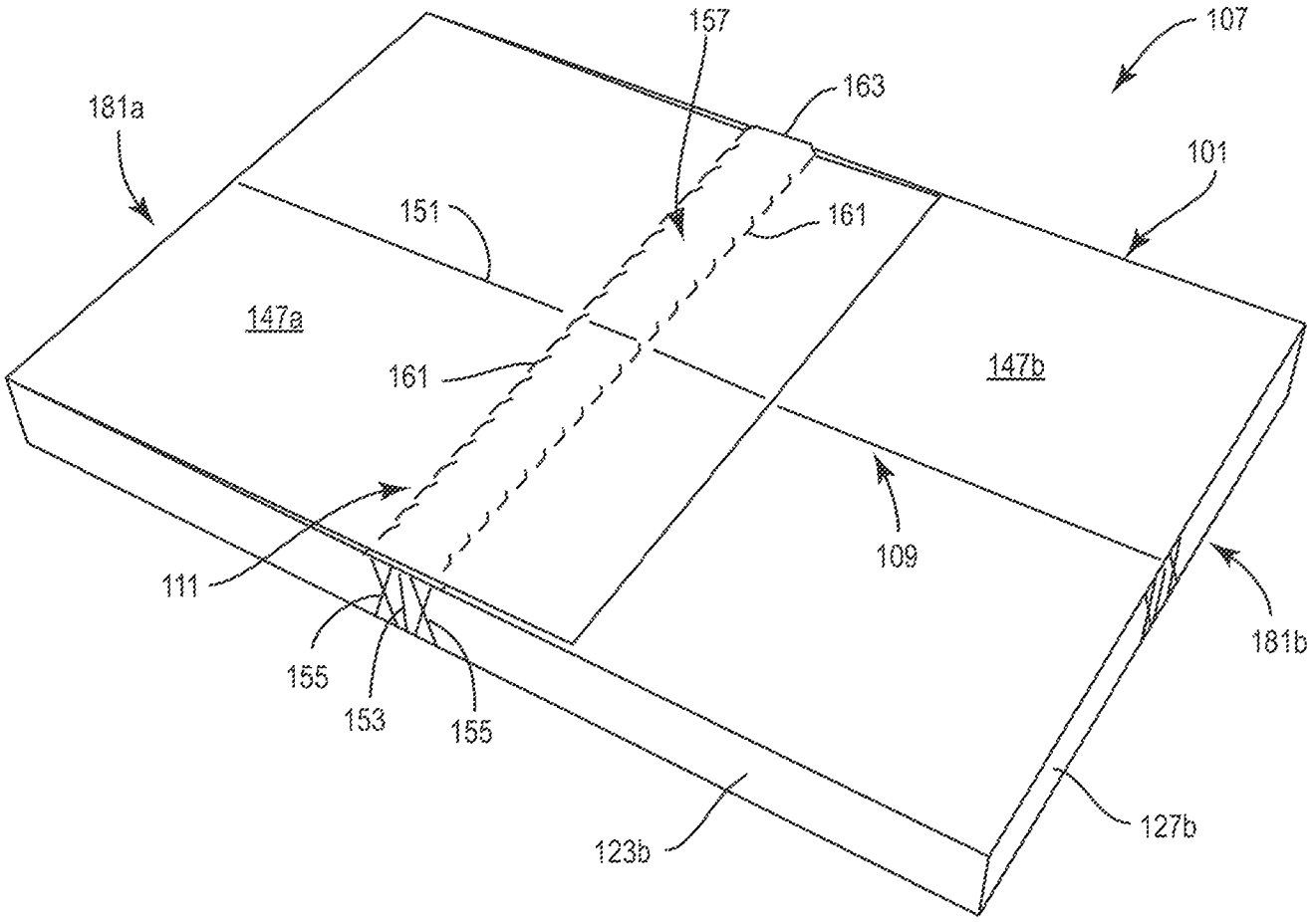
FIG. 5 is a perspective view of a package according to the first exemplary embodiment of the disclosure.

As shown in FIGS. 4 and 5, the cover panels 147*a*, 147*b* and the end panels 127*a*, 127*b* can be folded to form the carton 101 (FIG. 5). In the illustrated embodiment, the second end panel 127*b* and the second cover panel 147*b* can be folded along the lateral fold lines 129*b*, 149*b* so that the second end panel 127*b* at least partially overlaps the ends of the compartments 103 and the second cover panel 147*b* partially overlaps the front panels 131*a*, 131*b*. In one embodiment, glue spots G2 (FIGS. 1 and 3B) can be applied to the front panels 131*a*, 131*b* (and/or to the second cover panel 147*b*) to adhere the second cover panel 147*b* to the front panels 131*a*, 131*b*. As shown in FIG. 4, the end flaps 143*a*, 143*b* can be folded along the lateral fold lines 145*a*, 145*b* to partially overlap the end of the compartment 105 and the first end panel 127*a* and the first cover panel 147*a* can be folded along the lateral fold lines 129*a*, 149*a* so that the first end panel 127*a* at least partially overlaps the end flaps 143*a*, 143*b* and the end of the compartment 105 and the first cover panel 147*a* partially overlaps the front panels 131*a*, 131*b* and the second cover panel 147*b*. In one embodiment, a glue strip G3 can be applied to the first cover panel 147*a* (FIG. 1) and/or a glue strip G3' can be applied to the second cover panel 147*b* (FIG. 4) to adhere the cover panels 147*a*, 147*b* together when the carton 101 is closed (FIG. 5). Further, glue spots G4 (FIGS. 1 and 4) can be applied to the front panels 131*a*, 131*b* (and/or to the first cover panel 147*a*) to adhere the first cover panel 147*a* to the front panels 131*a*, 131*b*.

As shown in FIG. 5, with the cover panels 147*a*, 147*b* overlapped and secured, at least the end panels 127*a*, 127*b* can close the ends 181*a*, 181*b* of the carton 101 and at least the back panel 121, the side panels 123*a*, 123*b*, the end panels 127*a*, 127*b*, and the cover panels 147*a*, 147*b* can extend around an interior 183 (FIG. 6A) of the carton 101. In the illustrated embodiment, the carton 101 with the articles C, P contained therein as shown in FIG. 5 can form the package 107. As shown in FIG. 5 and in FIGS. 8A and 8B (as described in more detail below), the flexibility features 109 (including the longitudinal score line 151, the lateral score line 153, the oblique scores 155, and/or portions of the tear strip 157) can be arranged along (e.g., approximately along, generally along, substantially along, etc.) the axes of the carton 101 for allowing the package 107 to bend according to the United States Postal Service's standards for flat-size mailpieces as described in more detail below. The carton 101 and the package 107 could be otherwise formed without departing from the disclosure.

Figure 6A:
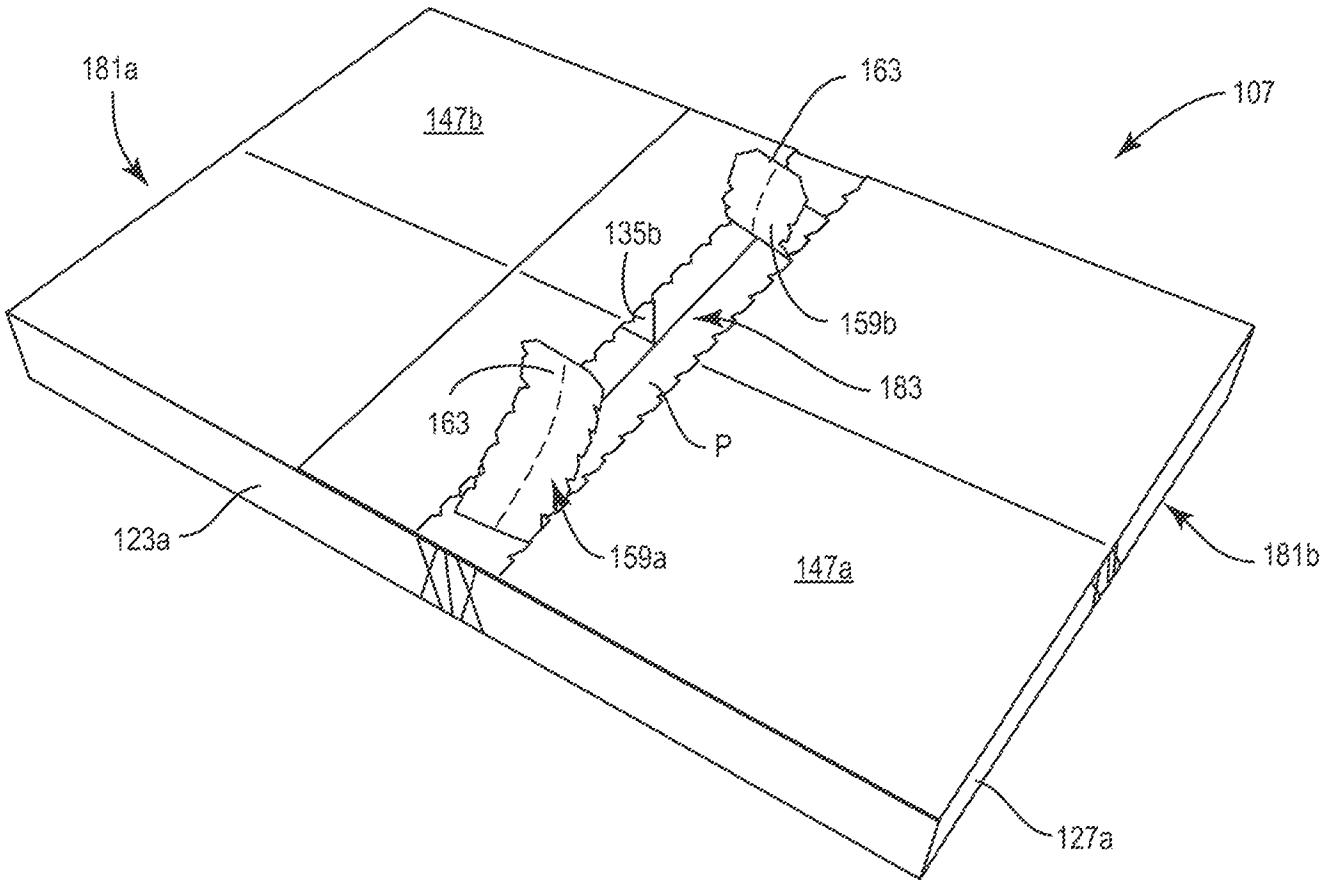
FIGS. 6A and 6B are perspective views showing opening of the package of FIG. 5 according to the first exemplary embodiment of the disclosure.
Figure 6B:
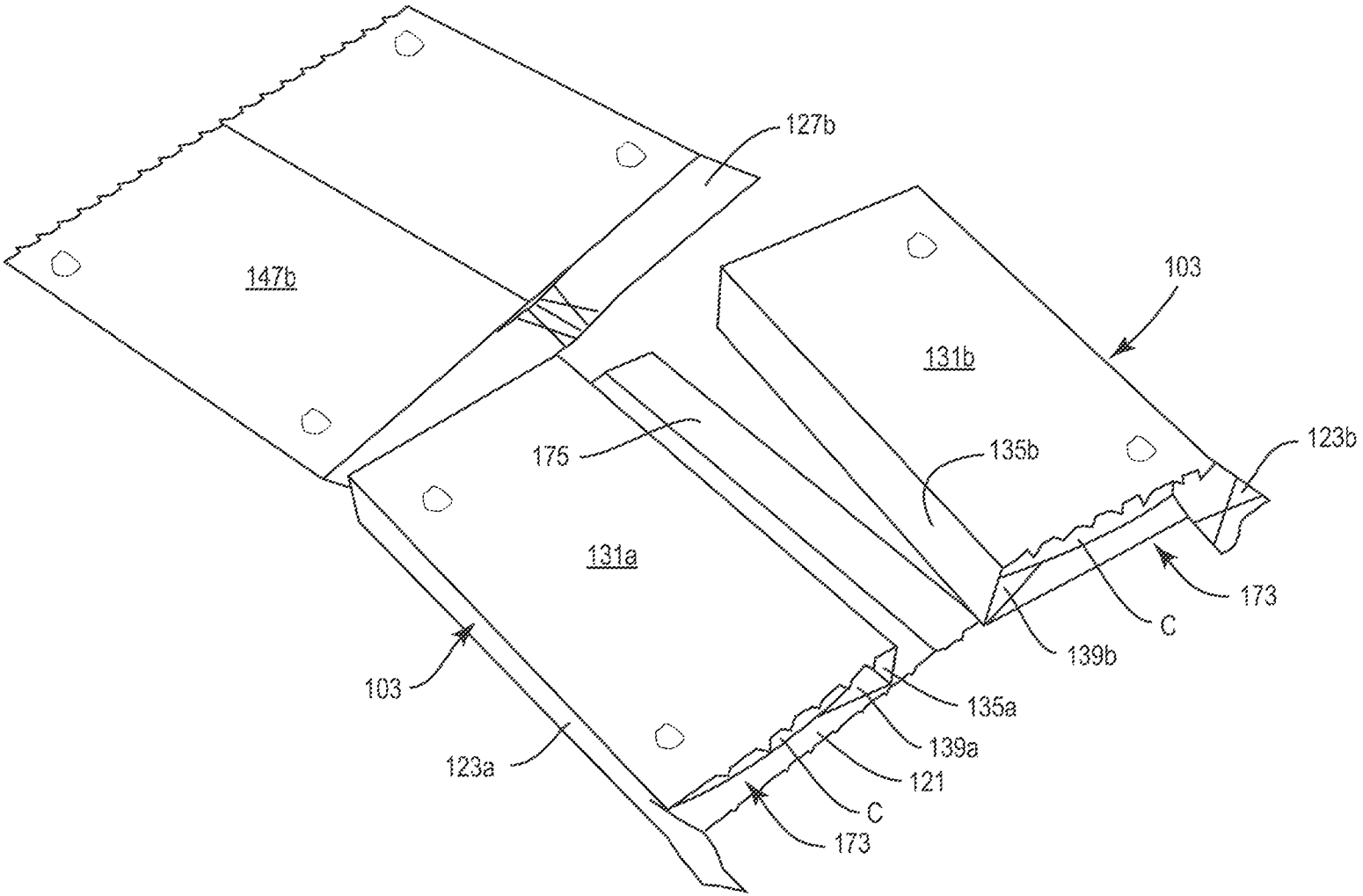
Figure 7:
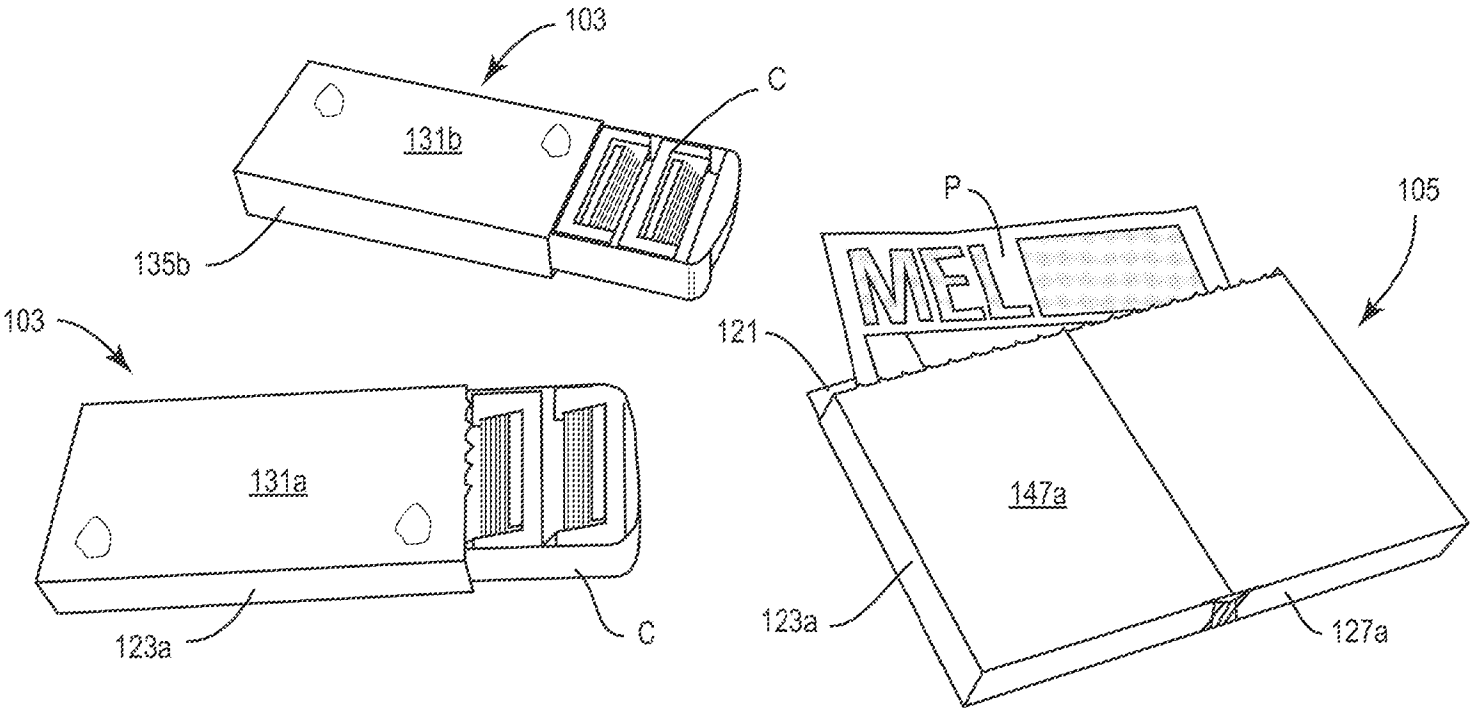
FIG. 7 is a perspective view of separated compartments formed from the package of FIG. 5 according to the first exemplary embodiment of the disclosure.

As shown in FIGS. 6A-7, the carton 101 can be opened and the compartments 103, 105 can be separated to break up the package 107 and to allow access to the articles C, P in the compartments 103, 105. For example, as shown in FIG. 6A, the tear strip 157 can be torn away from the first cover panel 147*a* (e.g., by grasping the start tab 163 and pulling the tear strip 157 apart from the first cover panel 147*a*). In one embodiment, at least partially removing the tear strip 157 can expose the tear strips 159*a*, 159*b* in the front panels 131*a*, 131*b* in the interior 183 of the carton 101. As shown in FIG. 6A, the tear strips 159*a*, 159*b* can be torn away from the front panels 131*a*, 131*b* (e.g. by grasping the start tabs 163 and pulling the tear strips 159*a*, 159*b* apart from the front panels 131*a*, 131*b*). As shown in FIG. 6B, the carton 101 can be torn along the lateral tear line 169 in the back panel 121 and along portions of the side panels 123*a*, 123*b* to at least partially separate the compartment 105 from the remainder of the carton 101 (e.g., including at least the second cover panel 147*b*, the compartments 103, and the tear-away section 175). Also as shown in FIG. 6B, the second cover panel 147*b* and the second end panel 127*b* can be separated from the compartments 103 and the tear-away section 175, such as by grasping the second cover panel 147*b* at an edge, pulling the second cover panel 147*b* upwardly away from the front panels 131*a*, 131*b* (e.g., separating the glue spots G2) and tearing the second end panel 127*b* away from the back panel 121 along the tear line 129*b*. In addition, the tear-away section 175 can be removed from the compartments 103 by tearing along the tear lines 171*a*, 171*b* (FIGS. 1 and 2). As shown in FIG. 7, the articles C, P can be removed from the separate compartments 103, 105 as desired. The package 107 could be otherwise opened and/or the compartments 103, 105 could be otherwise separated without departing from the disclosure. For example, any or all of the articles C, P could be removed from the compartments 103, 105 before and/or during the separation of the compartments 103, 105. Alternatively, the carton 101 could be opened and the articles C, P could be removed without separating the compartments 103, 105.

Figure 8A:
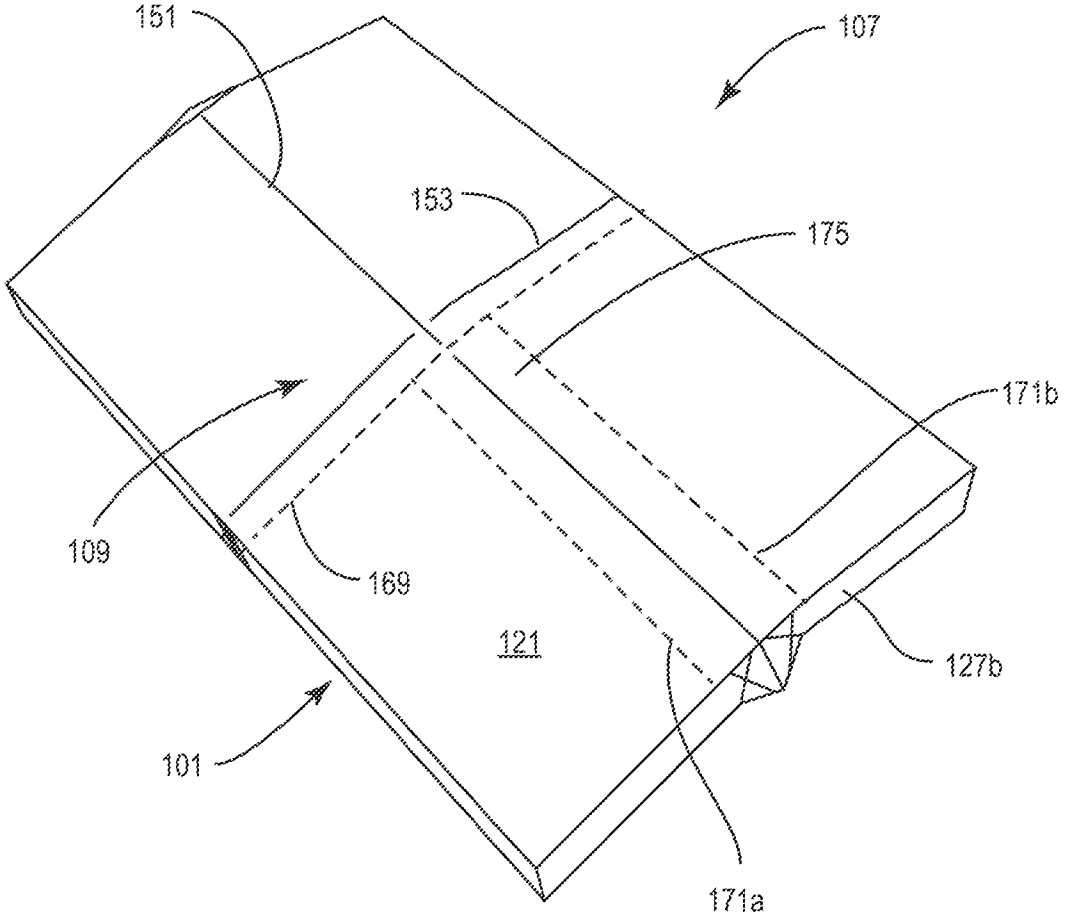
FIGS. 8A and 8B are perspective views of showing the flexing/bending of the package of FIG. 5 according to the first exemplary embodiment of the disclosure.
Figure 8B:
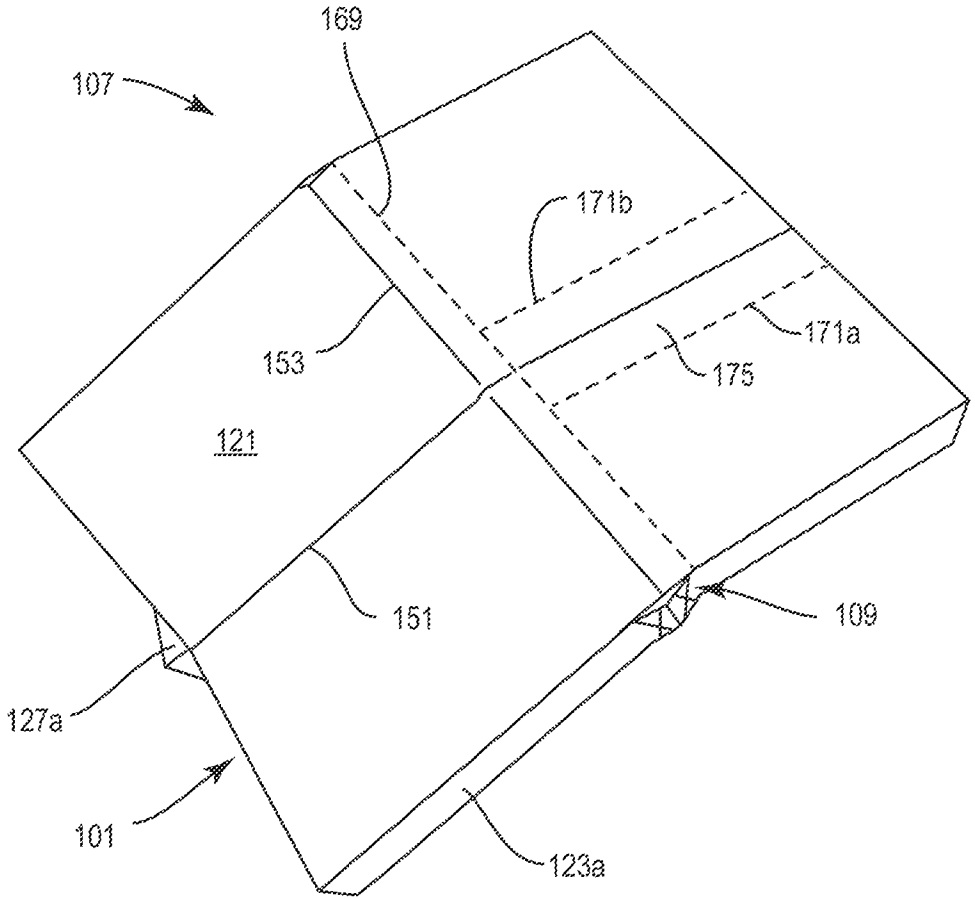

In one embodiment, the package 107 can at least partially comply with flexibility standards for United States Postal Service flat-size mailpieces (e.g., the Mailing Standards of the United States Postal Service Domestic Mail Manual 201.4.3 and/or other standards) and/or other shipping, mailing, storage, etc. standards and/or requirements. For example, as shown in FIG. 8A, the package 107 can bend along at least the longitudinal score 151 extending in the back panel 121, the end panels 127*a*, 127*b*, and the cover panels 147*a*, 147*b*. In one embodiment, the oblique scores 155 in the end panels 127*a*, 127*b* can help the end panels 127*a*, 127*b* deform as the package 107 is flexed. Similarly, as shown in FIG. 8B, the package 107 can bend along the axis that is transverse to the longitudinal score 151. For example, the package 107 can bend along the lateral score 153 extending in the back panel 121 and the side panels 123*a*, 123*b* and along portions of the tear strip 157 in the front panel 157. In one embodiment, the front panels 131*a*, 131*b* in the interior 183 of the carton 101 can also bend along portions of the tear strips 159*a*, 159*b* (e.g., along the fold lines 167). In one embodiment, the oblique scores 155 in the side panels 123*a*, 123*b* can help the side panels 123*a*, 123*b* deform as the package 107 is flexed. As shown in FIG. 8B, the back panel 121 can bend along the lateral score 153 and/or the tear line 169 in one embodiment. The package 107 could otherwise bend or flex or could be less capable of flexing and/or bending without departing from the disclosure.

Figure 9:
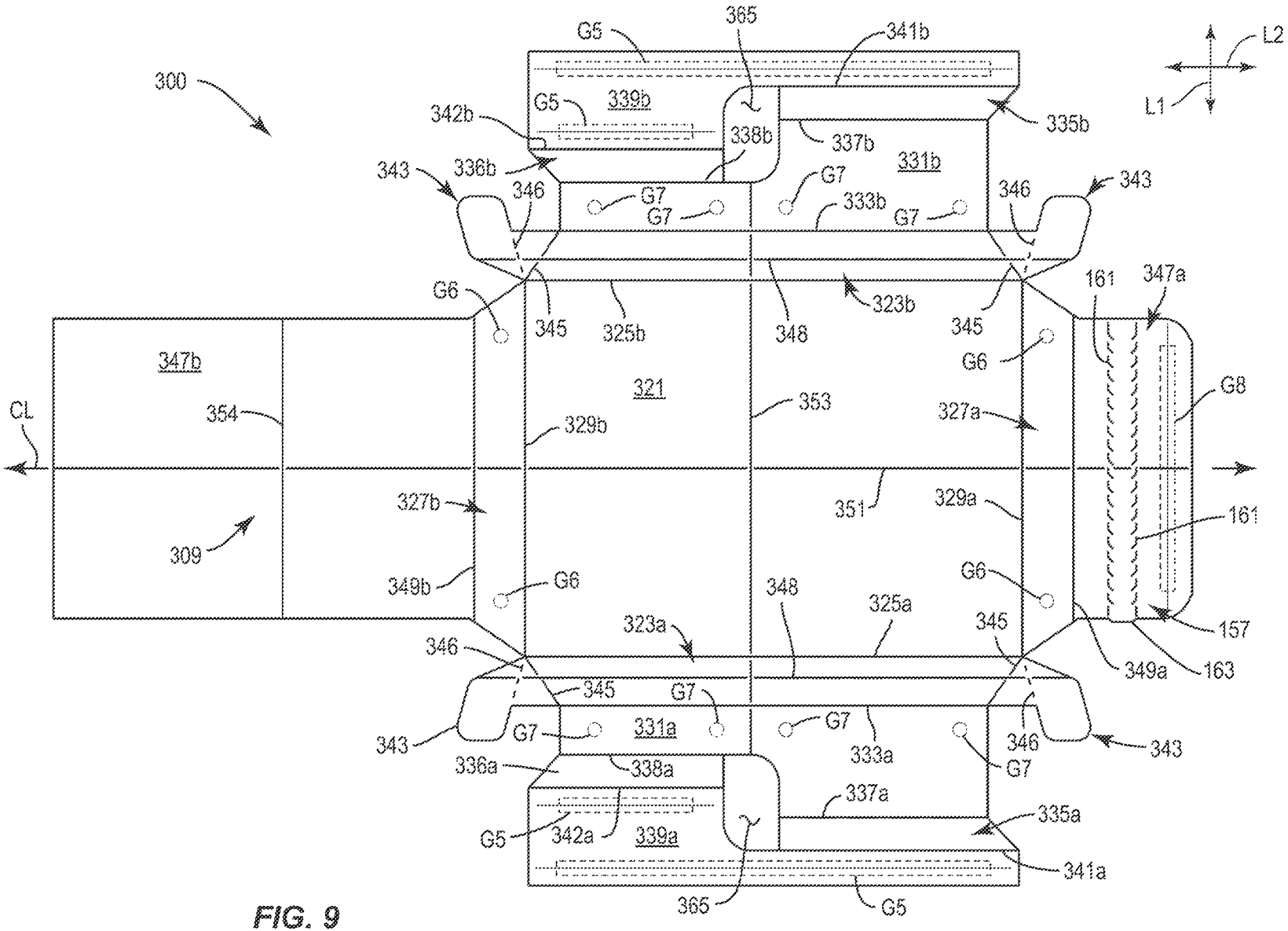
FIG. 9 is an interior plan view of a blank used to form a carton of a package according to a second exemplary embodiment of the disclosure.

FIG. 9 is a plan view of a blank 300 for forming a package 307 (FIG. 11) including a carton 301 and the articles C, P (FIG. 12) or other articles according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 9, the blank 300 includes different panels for forming compartments 303, 305 and different flexibility features 309 with respect to the blank 100 of the first embodiment as described in more detail below. In the illustrated embodiment, the opening features 311 (FIG. 11) include one tear strip 157 in the blank 300, and the tear strips 159*a*, 159*b* of the first embodiment are omitted in the blank 300.

In the illustrated embodiment, the blank 300 has a back panel 321 foldably connected to a first side panel 323*a* along a longitudinal fold line 325*a* and a second side panel 323*b* along a longitudinal fold line 325*b*. A first end panel 327*a* is foldably connected to the back panel 321 along a lateral fold line 329*a* and a second end panel 327*b* is foldably connected to the back panel 321 along a lateral fold line 329*b*. As shown in FIG. 9, the blank 300 has a first front panel 331*a* foldably connected to the first side panel 323*a* along a longitudinal fold line 333*a* and a second front panel 331*b* foldably connected to the second side panel 323*b* along a longitudinal fold line 333*b*. Divider panels 335*a*, 336*a* can be foldably connected to the first front panel 331*a* along respective longitudinal fold lines 337*a*, 338*a* and a first attachment panel 339*a* can be foldably connected to the divider panels 335*a*, 336*a* along respective longitudinal fold lines 341*a*, 342*a*. Similarly, divider panels 335*b*, 336*b* can be foldably connected to the second front panel 331*b* along respective longitudinal fold lines 337*b*, 338*b* and a second attachment panel 339*b* can be foldably connected to the divider panels 335*b*, 336*b* along respective longitudinal fold lines 341*b*, 342*b*. In the illustrated embodiment, the blank 300 can include an opening 365 at least partially defined by edges of the first front panel 331*a*, the divider panels 335*a*, 336*a*, and the first attachment panel 339*a* and an opening 365 at least partially defined by edges of the second front panel 331*b*, the divider panels 335*b*, 336*b*, and the second attachment panel 339*b*.

As shown in FIG. 9, the fold lines 337*a*, 337*b* can be spaced apart from the respective fold lines 333*a*, 333*b* than are the respective fold lines 338*a*, 338*b* so that the front panels 331*a*, 331*b* are wider between the respective side panels 323*a*, 323*b* and the respective divider panels 335*a*, 335*b* than they are between the respective side panels 323*a*, 323*b* and the respective divider panels 336*a*, 336*b*. In addition, in one embodiment, the fold lines 341*a*, 341*b* can be spaced farther apart from the respective fold lines 333*a*, 333*b* than are the respective fold lines 342*a*, 342*b* so that the portions of the attachment panels 339*a*, 339*b* that are foldably connected to the respective divider panels 336*a*, 336*b* are wider where than are the portions of the attachment panels 339*a*, 339*b* that are foldably connected to the respective divider panels 335*a*, 335*b*.

In one embodiment, end flaps 343 can be foldably connected to each of the respective ends of the respective side panels 323*a*, 323*b* along respective lateral fold lines 345. As shown in FIG. 9, each of the end flaps 343 includes an oblique fold line 346 so that the end flaps 343 can be folded to form respective gussets at the corners of the carton 301. In one embodiment, each of the end flaps 343 can include an extension or tab for being glued to the respective end panel 327*a*, 327*b* when the carton 301 is formed. As shown in FIG. 9, an intermediate fold line 348 can extend in each of the side panels 323*a*, 323*b* and end flaps 343. In the illustrated embodiment, the intermediate fold lines 348 can extend in the longitudinal direction L2 and can be spaced from the longitudinal fold lines 325*a*, 333*a*, 325*b*, 333*b*.

In the illustrated embodiment, the blank 300 can include a first cover panel 347*a* foldably connected to the first end panel 327*a* along a lateral fold line 349*a* and a second cover panel 347*b* foldably connected to the second end panel 327*b* along a lateral fold line 349*b*. Any of the back panel 321, the side panels 323*a*, 323*b*, the end panels 327*a*, 327*b*, the front panels 331*a*, 331*b*, the divider panels 335*a*, 335*b*, 336*a*, 336*b*, the attachment panels 339*a*, 339*b*, the end flaps 343, and/or the cover panels 347*a*, 347*b* could be omitted or could be otherwise arranged, shaped, positioned, and/or configured without departing from the disclosure.

As shown in FIG. 9, the flexibility features 309 can include a longitudinal score 351 extending along a longitudinal axis of the blank 300 (e.g., similar to the longitudinal score 151 of the first embodiment) along the back panel 321, the end panels 327*a*, 327*b*, and the cover panels 347*a*, 347*b*. The flexibility features 309 further can include a lateral score 353 (e.g., similar to the lateral score 153 in the first embodiment) and a lateral score 354. In the illustrated embodiment, the lateral score 353 can extend along the back panel 321 and the side panels 323*a*, 323*b*, and the front panels 331*a*, 331*b*. In one embodiment, the lateral score 353 further can extend in the attachment panels 339*a*, 339*b*. As shown in FIG. 9, the lateral score 354 extends in the second cover panel 347*b*. Any of the flexibility features 309, including the scores 351, 353, 354, could be omitted or could be otherwise arranged, shaped, positioned, and/or configured without departing from the disclosure.

Figure 10:
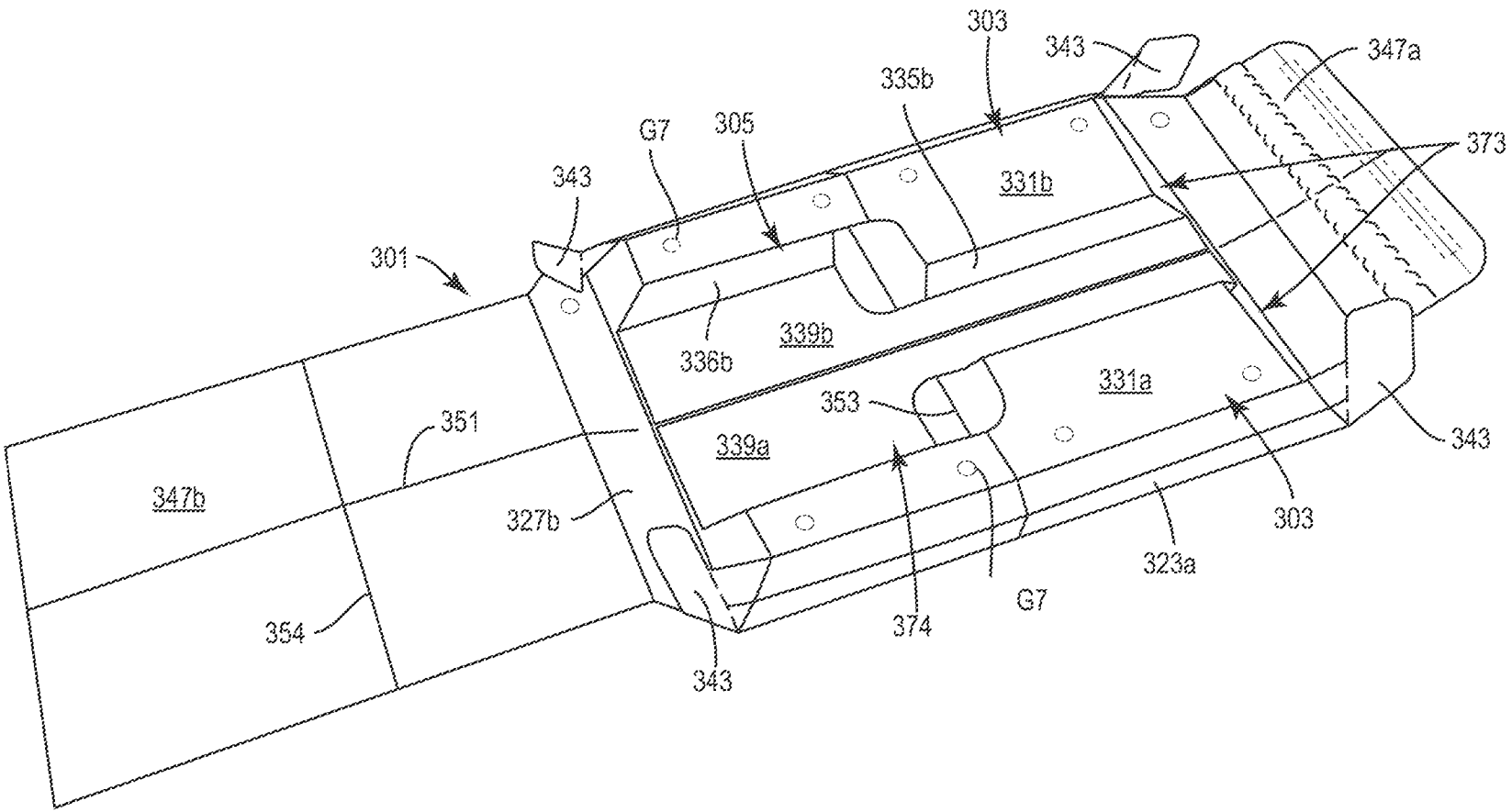
FIG. 10 is a perspective view of a partially-formed carton formed from the blank of FIG. 9 according to a second exemplary embodiment of the disclosure.

In one embodiment, the package 307 can be formed similarly to the package 107 of the first embodiment. For example, as shown in FIG. 10, the blank 300 can be folded along the longitudinal fold lines 333*a*, 333*b* and the attachment panels 339*a*, 339*b* can be glued in face-to-face contact with the back panel 321 (e.g., by glue strips G5). The blank 300 can be folded along the longitudinal fold lines 325*a*, 325*b*, 333*a*, 333*b*, 337*a*, 337*b*, 338*a*, 338*b*, 341*a*, 341*b*, 342*a*, 342*b* to move the front panels 331*a*, 331*b* away from the back panel 321 and to position the side panels 323*a*, 323*b* and the divider panels 335*a*, 335*b*, 336*a*, 336*b* to extend at least upwardly from the back panel 321 to the front panels 331*a*, 331*b* (FIG. 10). Accordingly, in one embodiment, the back panel 121, the first side panel 323*a*, the first front panel 331*a*, and the divider panel 335*a* and the back panel 121, the second side panel 323*b*, the second front panel 331*b*, and the divider panel 335*b* can extend at least partially around respective interior spaces 373 of respective compartments 303 (FIG. 10). In addition, the divider panels 336*a*, 336*b* and portions of the attachment panels 339*a*, 339*b* can extend along at least a portion of a recess 374 to at least partially form a compartment 305 (FIG. 10). In one embodiment, the articles C, P can be loaded into the compartments 303, 305 (e.g., see FIG. 12) similarly to the first embodiment. The compartments 303, 305 could be alternatively formed and/or the articles C, P could be alternatively loaded without departing from the scope of the disclosure.

Figure 11:
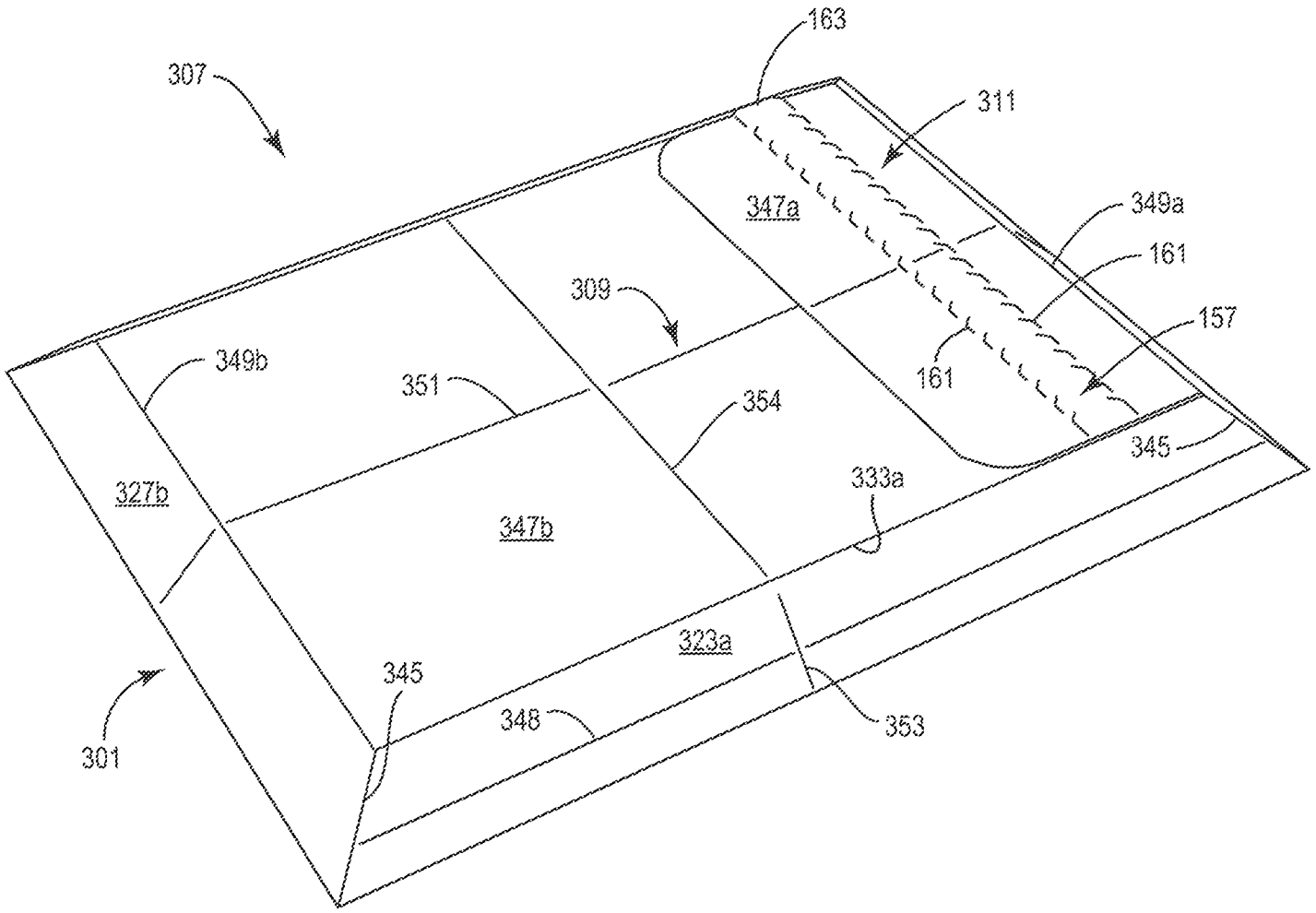
FIG. 11 is a perspective view of a package formed from at least the partially-formed carton of FIG. 10 according to the second exemplary embodiment of the disclosure.

In the illustrated embodiment, the end flaps 343 can be folded along the fold lines 345, 346 and can be glued in face-to-face contact with the respective end panels 327*a*, 327*b* (e.g., at glue spots G6). Alternatively, the glue spots G6 could be omitted so that the end flaps 343 are not glued to the end panels 327*a*, 32*b*. In one embodiment, gluing the end flaps 343 to the end panels 327*a*, 327*b* can cause the blank 300 to fold along the fold lines 329*a*, 329*b* so that the end panels 323*a*, 323*b* extend over the ends of the carton, the first end panel 329*a* at least partially closing the ends of the compartments 303 and the second end panel 329*b* at least partially closing the end of the compartment 305. As shown in FIG. 11, the side panels 323*a*, 323*b* and the end panels 327*a*, 327*b* can be folded to extend obliquely (e.g. upwardly and inwardly) from the back panel 321. The second cover panel 347*b* can be folded along the lateral fold line 349*b* and can be positioned to overlap the front panels 331*a*, 331*b*. In one embodiment, the second cover panel 347*b* can be glued in face-to-face contact with the front panels 331*a*, 331*b* (e.g., at glue spots G7). In one embodiment, the second cover panel 347*b* can extend along the interior 374 and can at least partially close the compartment 305. Subsequently, the first cover panel 347*a* can be folded along the lateral fold line 349*a* to at least partially overlap the second cover panel 347*b* and can be glued in face-to-face contact with the second cover panel 347*b* (e.g., along glue strip G8). The carton 301 and/or the package 307 could be otherwise formed without departing from the disclosure.

In one embodiment, the package 307 can be flexed and/or bent in a similar manner as the package 107 of first embodiment (e.g., for at least partially complying with flexibility standards for United States Postal Service flat-size mailpieces).

Figure 12:
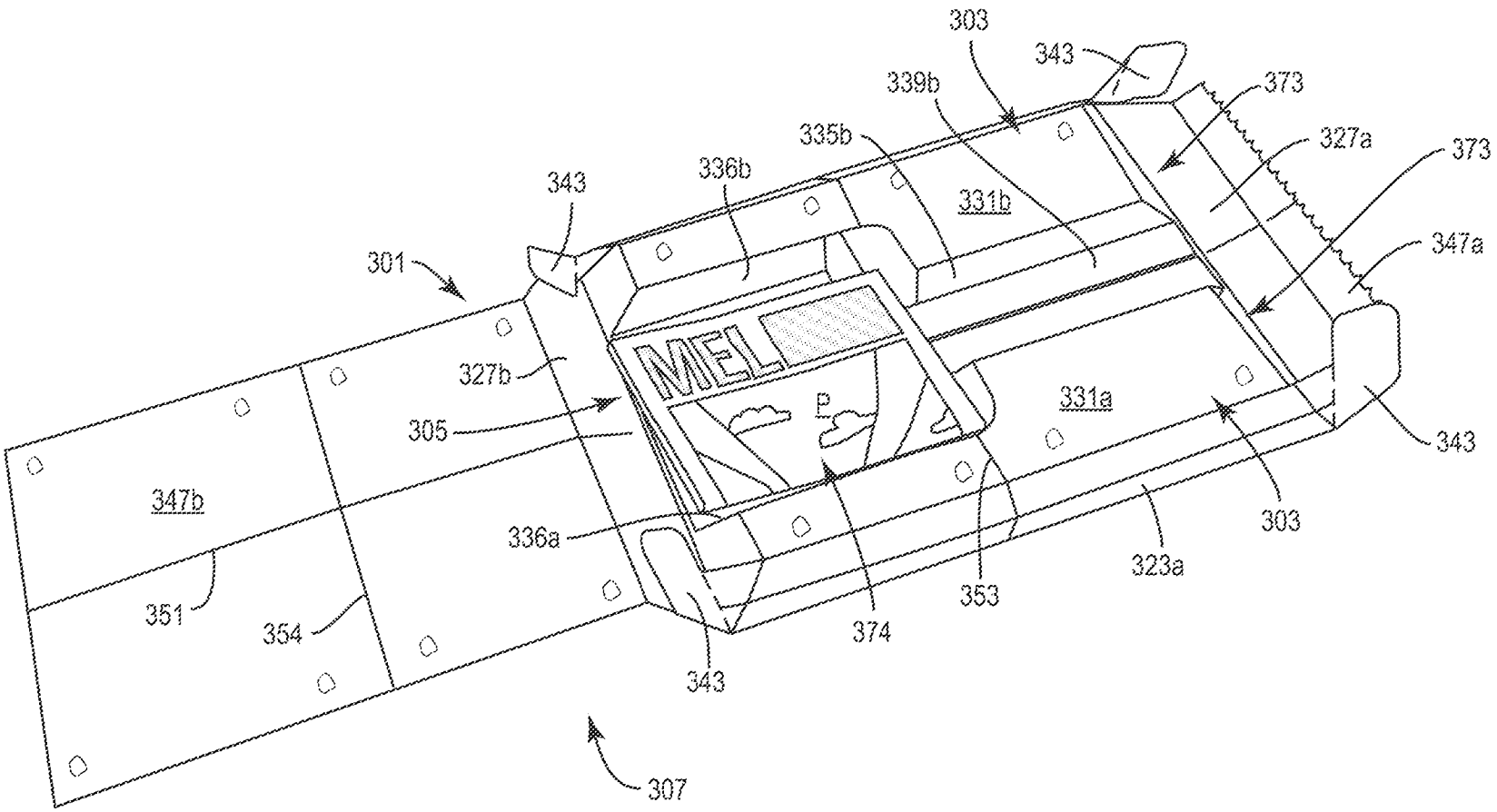
FIG. 12 is a perspective view of the package of FIG. 11 in an open configuration according to the second exemplary embodiment of the disclosure.

As shown in FIG. 12, the package 307 can be at least partially opened by tearing the tear strip 157 in the first cover panel 347*a* and pulling the second cover panel 347*b* upwardly away from the front panels 331*a*, 331*b*. Separating the second cover panel 347*b* from the front panels 331*a*, 331*b* can include tearing along the glue spots G7 (FIG. 12). In one embodiment, with the carton 301 in the open configuration of (FIG. 12), the articles C can be removed from the interior spaces 373 of the compartments 303 and the article P can be removed from the recess 374 of the compartment 305. The carton 301 could be alternatively opened and/or the articles C, P could be alternatively removed without departing from the disclosure.

Figure 13:
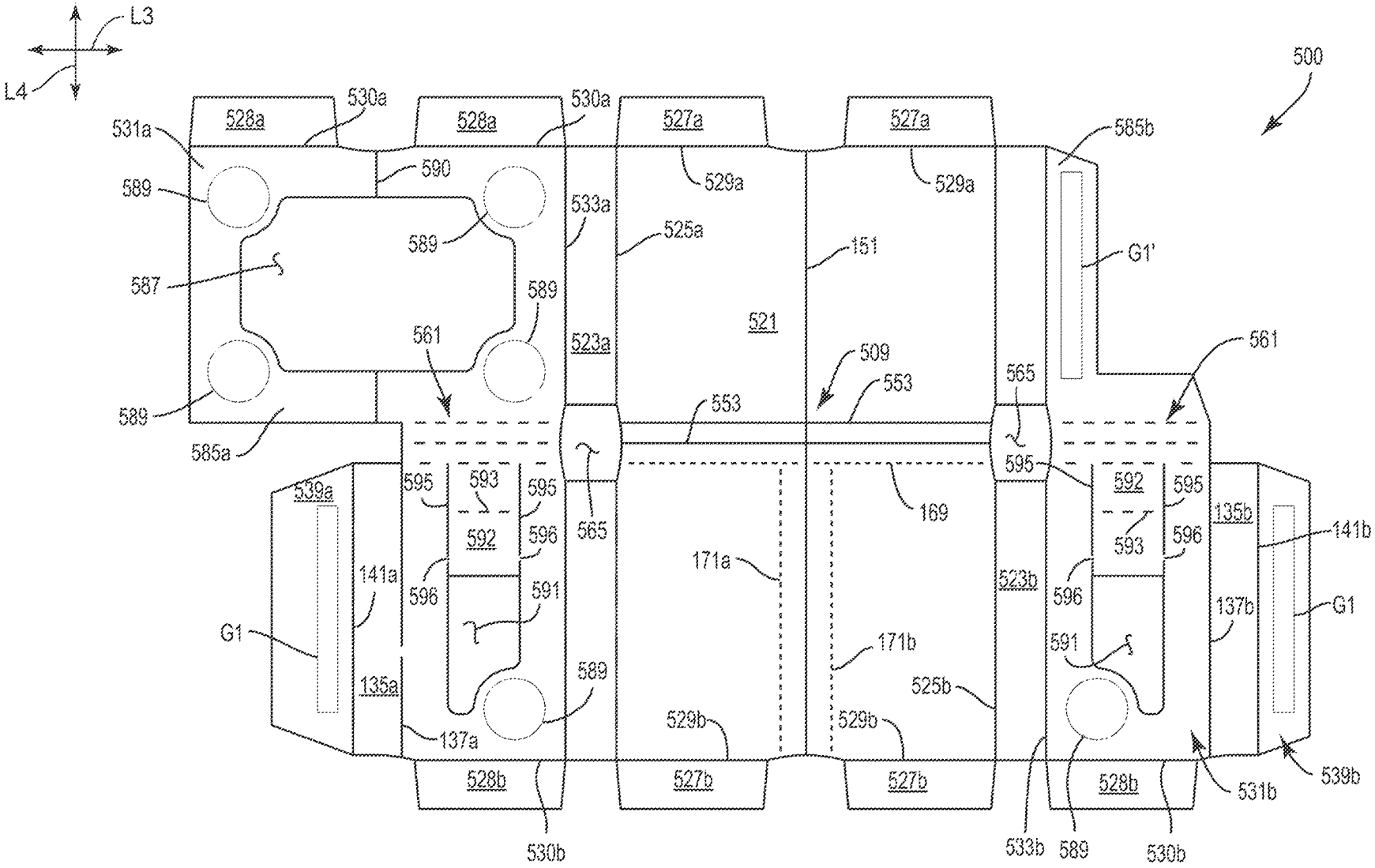
FIG. 13 is an exterior plan view of a blank used to form a carton of a package according to a third exemplary embodiment of the disclosure.
Figure 16:
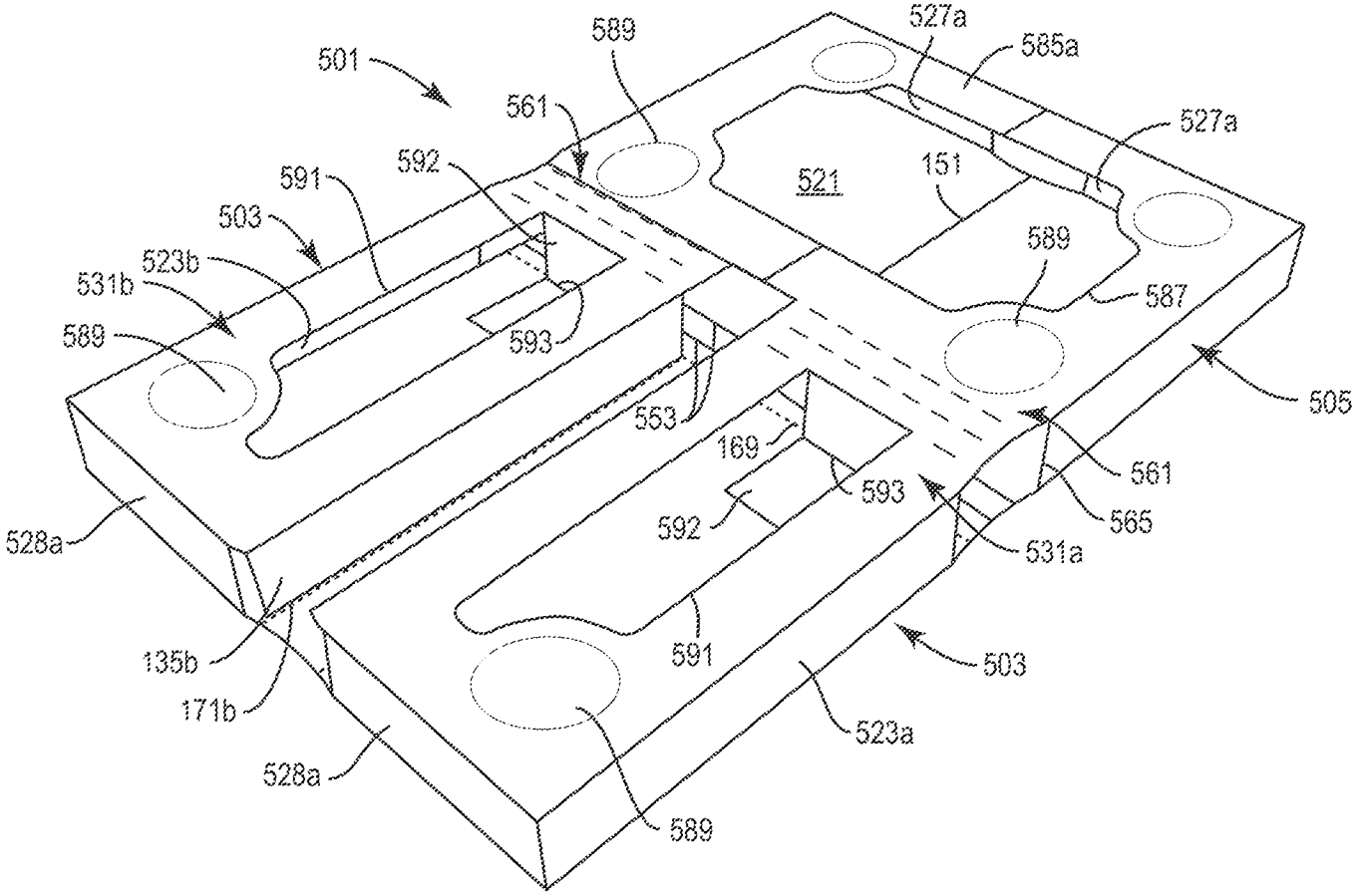

FIG. 13 is a plan view of a blank 500 for forming a package 507 (FIG. 17) including a carton 501 (FIGS. 16 and 17) and the articles C, P (FIG. 17) or other articles and FIG. 16 is a plan view of an envelope blank 600 for forming an envelope 601 (FIG. 17) for holding the package 507 according to a third embodiment of the disclosure. The third embodiment is generally similar to the prior embodiments, except for variations noted and variations that will be apparent to one of ordinary skill in the art. Accordingly, similar or identical features of the embodiments have been given like or similar reference numbers. As shown in FIG. 13, the L3 direction is longer than the L4 direction; however, for the purposes of the third embodiment, the L3 direction will be referred to as the lateral direction L3 of the blank 500 and the L4 direction will be referred to as the longitudinal direction L4 of the blank 500 so that the names of the features in the blank 500 and the carton 501 comport with the names of the features in the prior embodiments (e.g., the longitudinal score 151 and the lateral tear line 169 of the third embodiment comport with the respective longitudinal score 151 and lateral tear line 169 of the first embodiment). As shown in FIG. 13, the blank 500 includes a back panel 521 that is similar to the back panel 121 of the first embodiment except that the flexibility features 509 of the third embodiment include two lateral scores 553 in the back panel 521 rather than the one lateral score 153 in the back panel 121 of FIG. 1. In the illustrated embodiment, the cover panels 147*a*, 147*b* are omitted in the blank 500 and the back panel 521 is foldably connected to two back end flaps 527*a*, 527*b* at opposite ends (rather than the end panels 121*a*, 121*b*). As shown in FIG. 13, the end flaps 527*a*, 527*b* at the respective ends of the back panel 521 can be spaced apart by a cutout, which can be aligned with the longitudinal score 151 of the flexibility features 509 and with the longitudinal tear lines 171*a*, 171*b*. The back panel 521, the flexibility features 509, and/or the back end flaps 527*a*, 527*b* could be omitted or could be otherwise arranged, shaped, positioned, and/or configured without departing from the disclosure.

In the illustrated embodiment, the back panel 521 is foldably connected to the side panels 523*a*, 523*b* along respective longitudinal fold lines 525*a*, 525*b*, and front panels 531*a*, 531*b* are foldably connected to the respective side panels 523*a*, 523*b* along respective fold lines 533*a*, 533*b*. As shown in FIG. 13, the side panels 523*a*, 523*b* and the longitudinal fold lines 525*a*, 525*b*, 533*a*, 533*b* are interrupted by side openings 565 in the blank 500. In the illustrated embodiment, the side openings 565 are aligned with the lateral scores 553 of the flexibility feature 509 and the lateral tear line 169 in the back panel 521. As shown in FIG. 13, attachment flaps 539*a*, 539*b* can be similar to the attachment flaps 139*a*, 139*b* of the first embodiment, except that the first attachment flap 539*a* is larger. The side panels 523*a*, 523*b*, the front panels 531*a*, 531*b*, the side openings 565, and/or the attachment flaps 539*a*, 539*b* could be omitted or could be otherwise arranged, shaped, positioned, and/or configured without departing from the disclosure.

Figure 17:
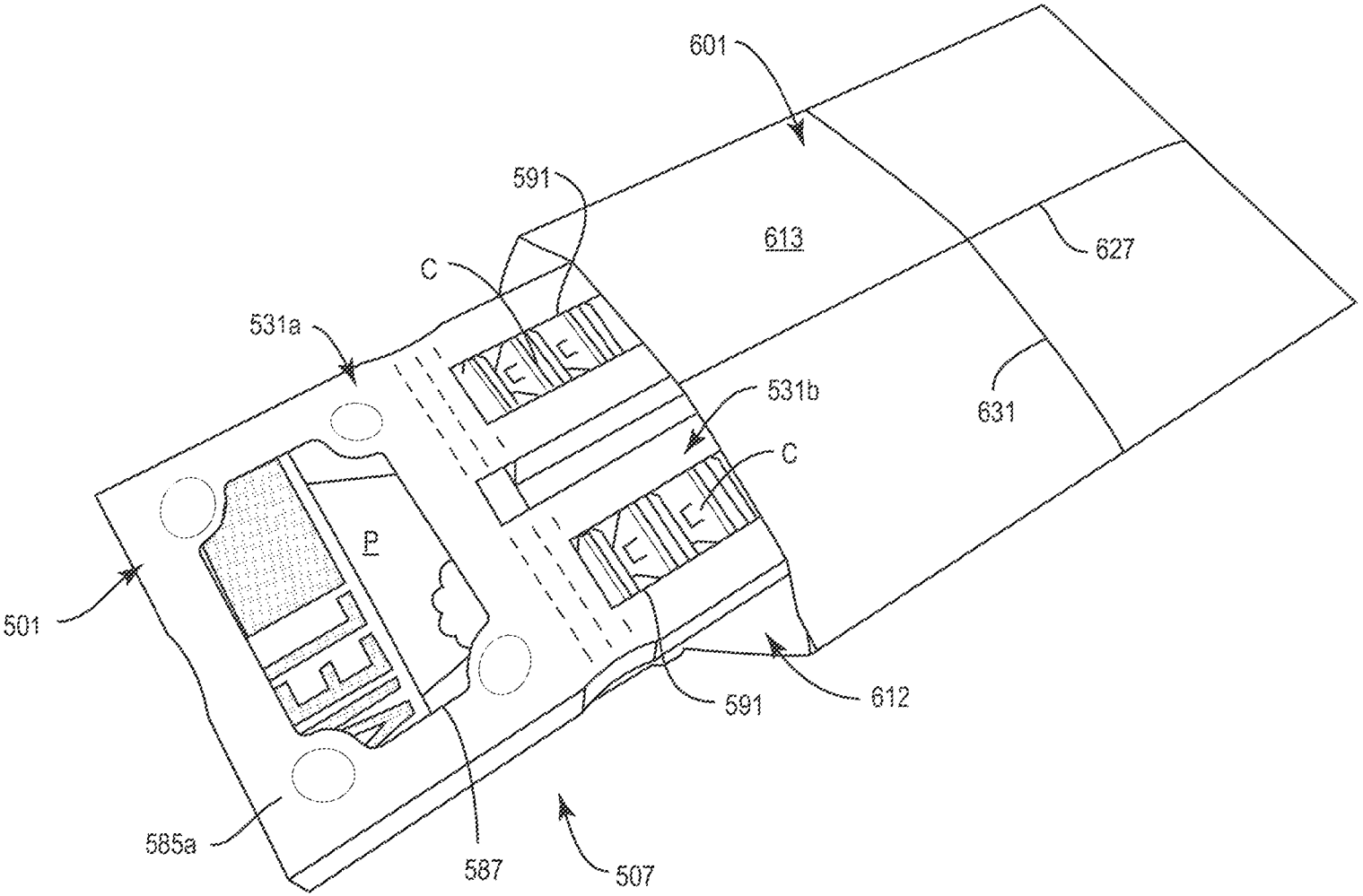
FIG. 17 is a perspective view of a package including the carton of FIG. 16 and articles held therein being inserted into an envelope formed from the envelope blank of FIG. 14 according to the third exemplary embodiment of the disclosure.

In the embodiments shown in FIGS. 1 and 9, the front panels 131*a*, 131*b* of the blank 100 and the front panels 331*a*, 331*b* of the blank 300 are symmetric (e.g., the first front panels 131*a*, 331*a* are mirror images of the second front panels 131*b*, 331*b*). As shown in FIG. 13, the portions of the front panels 531*a*, 531*b* that form the compartment 505 (FIG. 16) are different in the blank 500. The first front panel 531*a* includes an enlarged portion 585*a* that has a width (in the lateral direction L3) that is similar to or the same as the width (e.g., in the lateral direction L3) of the back panel 521 and the second front panel 531*b* has a smaller attachment portion 585*b* that is sized to receive a glue strip G1' (FIG. 13) for attachment to the enlarged portion 585*a* of the first front panel 531*a*. In one embodiment, a window 587 can extend in the enlarged portion 585*a* of the first front panel 531*a* so that the article P is visible through the first front panel 531*a* when the carton 501 is formed (FIGS. 16 and 17). In an exemplary embodiment, the edge of the window 587 in the enlarged portion 585*a* can have convex curved portions at the corners of the windows to accommodate locations 589 (schematically indicated by circles on the blank 500). In one embodiment, the locations 589 can provide engagement areas where suction cups (not shown) can engage the first front panel 531*a* during an automated assembly process (e.g., as described in more detail below. The portions 585*a*, 585*b*, the window 587, and/or the locations 589 could be omitted or could be otherwise arranged, shaped, positioned, and/or configured without departing from the disclosure.

As shown in FIG. 13, the enlarged portion 585*a* can include a front score 590, which is part of the flexibility features 509 and is aligned with the longitudinal score 151 when the carton 501 is formed and the front panel is positioned opposite to the back panel 521. In the illustrated embodiment, two front end flaps 528*a* can be foldably connected to the enlarged portion of the first end panel 531*a* along fold lines 530*a* for cooperating with the end flaps 527*a* for at least partially closing one end of the carton 507. As shown in FIG. 13, the front end flaps 528*a* are spaced apart from one another by a cutout, which can be aligned with the front score 590 of the flexibility features 509. In addition, front end flaps 528*b* can be foldably connected to the respective front panels 531*a*, 531*b* along fold lines 530*b* opposite to the front end flaps 528*a* for cooperating with the end flaps 527*b* to at least partially close the opposite end of the carton 507. The front end flaps 528*a*, 528*b* could be omitted or could be otherwise arranged, shaped, positioned, and/or configured without departing from the disclosure.

As shown in FIG. 13, the front panels 531*a*, 531*b* each include a plurality of perforations 561 (e.g., three lines of perforations 561, each) that extend in the L3 direction and are at least partially aligned with the openings 565, the lateral scores 553, and the lateral tear line 169. Accordingly, the lines of perforations 561 can cooperate with the flexibility features 509 for allowing the package 507 to flex as described above with respect to the first embodiment. In one embodiment, at least one of the lines of perforations 561 can form a tear line in the front panels 531*a*, 531*b* for separating the compartments of the package 507. Any of the lines of perforations 561 could be omitted or could be otherwise arranged, shaped, positioned, and/or configured without departing from the disclosure.

In the illustrated embodiment, each of the front panels 531*a*, 531*b* includes a window 591 extending in the portion of the front panels 531*a*, 531*b* the forms the compartments 503 of the carton 507 (FIG. 16). The windows 591 can provide product visibility when the package 507 is formed. As shown in FIG. 13, the edges of the windows 591 can include a respective concave curved portion for forming additional locations 589 in the front panels 531*a*, 531*b* for being engaged by suction cups (not shown). In the illustrated embodiment, inner flaps 592 can be foldably connected to the respective front panels 531*a*, 531*b* along the lines of perforations 561 and can extend in the respective windows 591 in the blank 500. Each of the inner flaps 592 can include an intermediate fold line 593 (e.g., a line of perforations or any other suitable fold line or tear line) that defines a distal portion and a proximal portion. In an exemplary embodiment, the inner flaps 592 can be separable from the respective front panels 531*a*, 531*b* along cut lines 595 and can be held in place by nicks 596 until the nicks are broken when forming the carton 507. The windows 591 and/or the inner flaps 592 could be omitted or could be otherwise arranged, shaped, positioned, and/or configured without departing from the disclosure.

Figure 14:
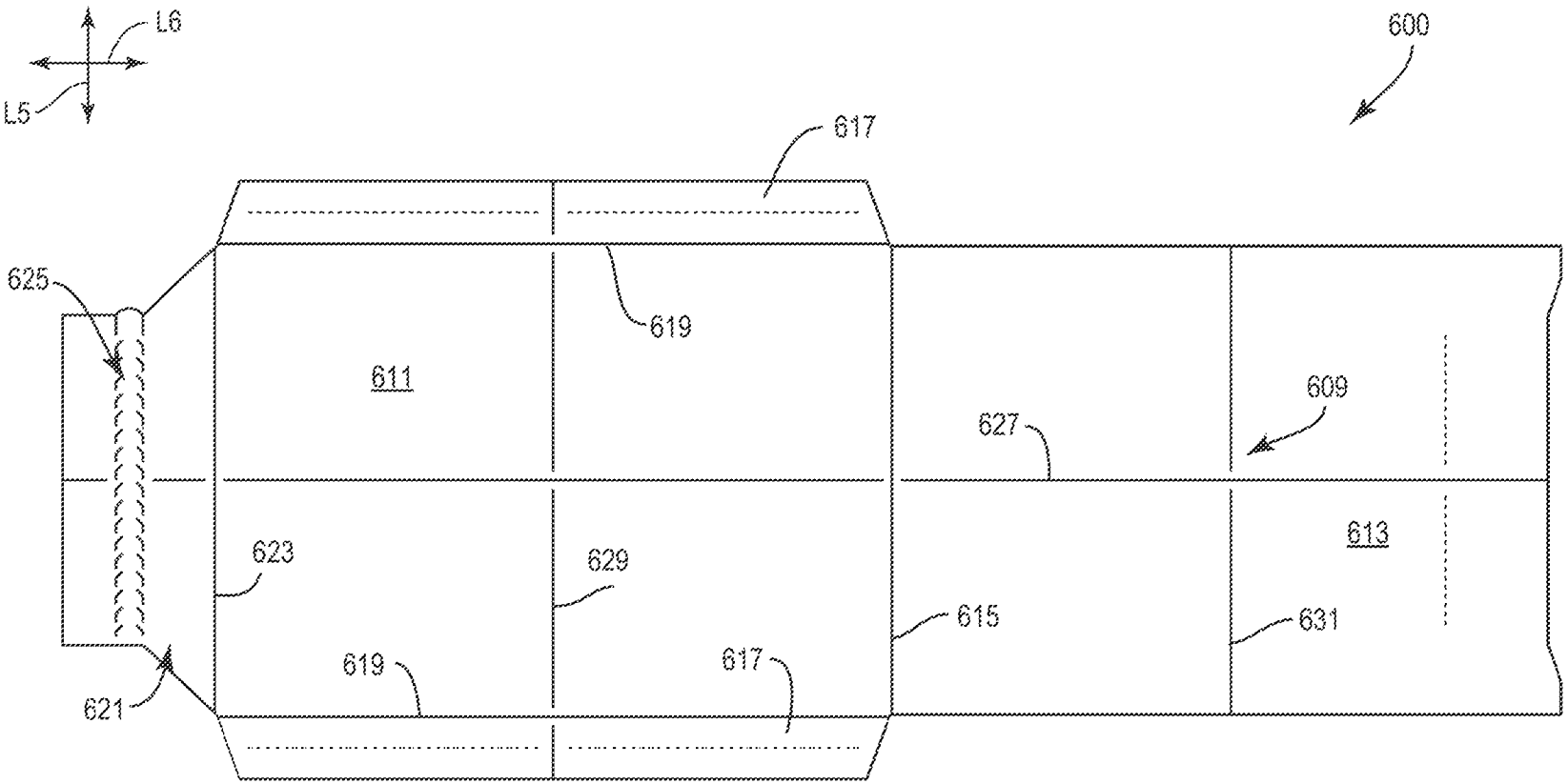
FIG. 14 is an interior plan view of an envelope blank used to form an envelope according to the third exemplary embodiment of the disclosure.

As shown in FIG. 14, the envelope blank 600 has a lateral axis L5 and a longitudinal axis L6. In the illustrated embodiment, the envelope blank 600 has a central panel 611 foldably connected to a cover panel 613 along a lateral fold line 615. In one embodiment, two side attachment flaps 617 are foldably connected to the central panel 611 along respective longitudinal fold lines 619 on opposing sides of the central panel 611. As shown in FIG. 14, an end attachment flap 621 can be foldably connected to the central panel 611 along a lateral fold line 623 at an opposite end of the central panel 611 from the cover panel 613. In an exemplary embodiment, the end attachment flap 621 can include a tear strip 625 for facilitating opening the envelope 601 formed from the envelope blank 600. As shown in FIG. 14, the envelope blank 600 can include flexibility features 609 similar to the flexibility features 509 for cooperating with the flexibility features 509. In the illustrated embodiment, the flexibility features 609 can include a longitudinal score 627 extending in the central panel 611, the cover panel 613, and the end attachment flap 621 (e.g., along a longitudinal axis of the envelope blank 600). The flexibility features 609 further can include a lateral score 629 extending in the central panel 611 and each of the side attachment flaps 617 and a lateral score 631 extending in the cover panel 613. The envelope blank 600 could be omitted or could be otherwise arranged, shaped, positioned, and/or configured without departing from the disclosure.

According to the illustrated embodiment, the carton 501 can be formed similarly to the cartons of the prior embodiments. For example, glue strips G1 can be applied to the exterior surfaces of the attachment flaps 539*a*, 539*b* and the glue strip G1' can be applied to the exterior surface of the attachment portion 585*b* of the second front panel 531*b*. In one embodiment, the first attachment flap 539*a* can be folded over the first divider panel 135*a* along the fold line 141*a* and the second attachment flap 539*b* and the second divider panel 135*b* can be folded over the second front panel 531*b* along the fold lines 137*b*. Subsequently, the second front panel 531*b* and the second side panel 523*b* can be folded over the back panel 521 along the fold line 525*b* and the first front panel 531*a* can be folded over the first side panel 523*a* and the back panel 521 along the fold line 533*a*. As the front panels 531*a*, 531*b* are folded, the attachment flaps 539*a*, 539*b* extend between the front panels 531*a*, 531*b* and the back panel 521 and so that the glue strips G1 secure the attachment flap 539*a*, 539*b* to the back panel 521 (FIG. 15) when the panels are folded and the partially-formed carton is in a flattened configuration. Additionally, when the first front panel 531*a* is folded along the fold line 533*a*, the enlarged portion 585*a* of the first front panel 531*a* can at least partially overlap the attachment portion 585*b* of the second front panel 531*b* so that the glue strip G1' can secure the attachment portion 585*b* and the enlarged portion 585*a* together (FIG. 15).

Figure 15:
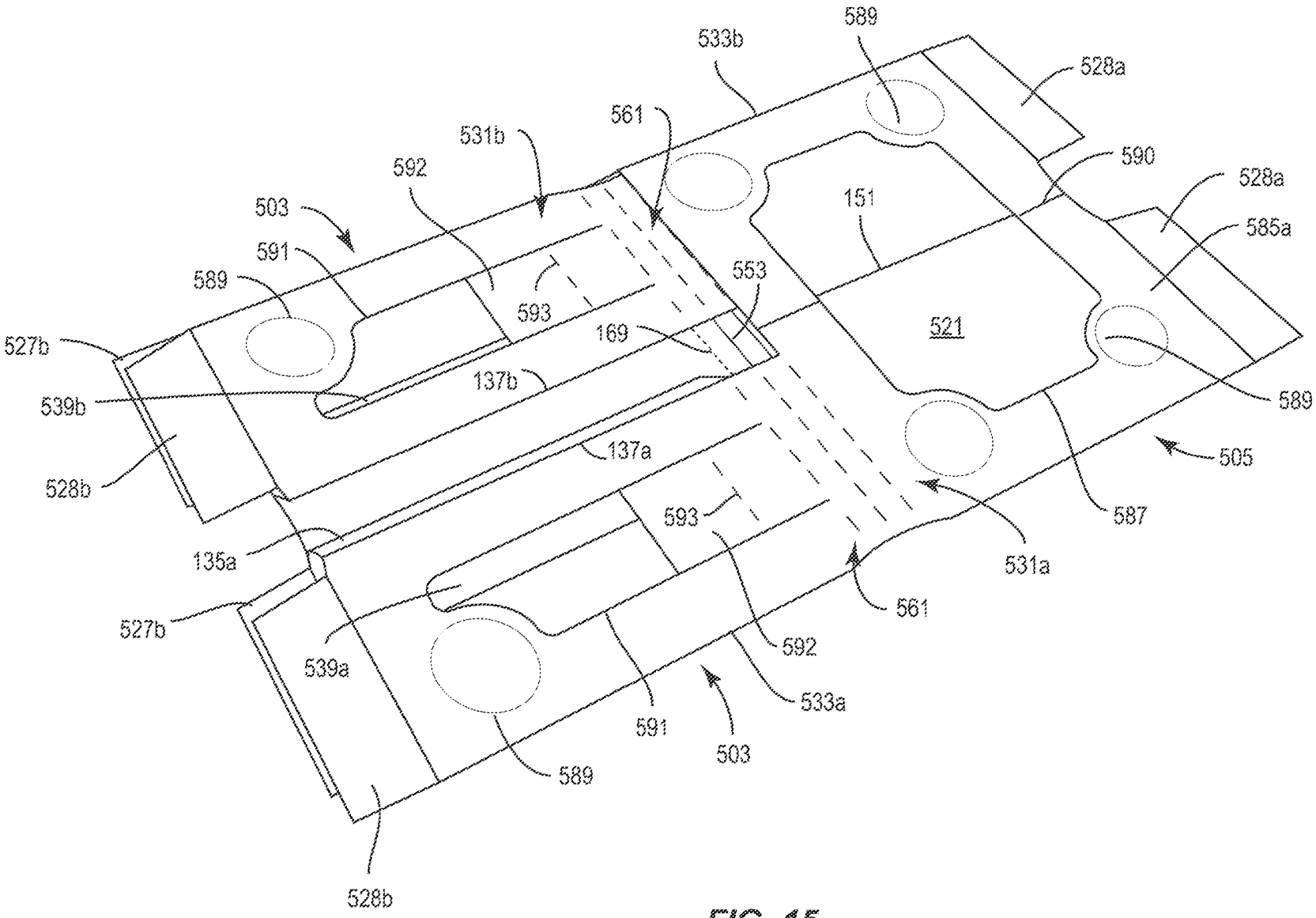
FIGS. 15 and 16 are perspective views of showing the formation of a carton from the blank of FIG. 13 according to the third exemplary embodiment of the disclosure.

As shown in FIG. 15, the partially-formed carton can be folded along the fold lines 525*a*, 525*b*, 533*a*, 533*b*, 137*a*, 137*b*, 141*a*, 141*b* to move the front panels 531*a*, 531*b* away from the back panel 521 and to extend opposite to the back panel 521. In some embodiments, the carton 501 can be moved from the flattened configuration to the erected configuration (FIG. 16) manually and/or in an automated apparatus (not shown), wherein suction cups mounted on an actuator engage the front panels 531*a*, 531*b* at locations 589 (schematically indicated by circles in FIGS. 15 and 16) and the actuator moves the front panels 531*a*, 531*b* into position opposite the back panel 521 while the back panel 521 is held in place (e.g., by vacuum pressure). In addition or alternatively, the suction cups can hold the front panels in position as the partially-formed carton is conveyed in a machine (e.g., during loading of the articles C into the carton). In one embodiment, the windows 587, 591 can provide product visibility while the locations 589 provide sufficient surface area on the front panels 531*a*, 531*b* for the suction cups to engage the carton (e.g., during erection of the carton, loading of the carton, and/or transport of the carton). As shown in FIG. 16, the end flaps 527*a*, 527*b*, 528*a*, 528*b* can be folded to overlap one another at the ends of the carton 501 and can be secured (e.g., glued) together to at least partially close the ends of the carton 501. In addition, as shown in FIG. 16, the inner flaps 592 can be folded along the intermediate fold lines 593 and one or more of the lines of perforation 561 so that the distal portions of the inner flaps 592 overlap the back panel 521 and the proximal portions of the inner flaps 592 extend from the back panel 521 to the respective front panels 531*a*, 531*b*. In one embodiment, the distal portions of the inner flaps 592 can be secured (e.g., glued by glue dots, glue strips, and/or other suitable features) to the back panel 521.

In the illustrated embodiment, the compartments 503 can be similar to the compartments 103, 303 of the prior embodiments. As shown in FIG. 16, portions of the respective front panels 531*a*, 531*b*, the respective side panels 523*a*, 523*b*, and the back panel 521 as well as the respective divider panels 135*a*, 135*b*, the respective attachment flaps 539*a*, 539*b*, the respective inner flaps 592, the respective back end flaps 527*b*, and the respective front end flaps 528*b* can extend at least partially around the respective interior spaces 573 of the compartments 503. In the illustrated embodiment, the compartment 505 can be similar to the compartments 105, 305 of the prior embodiments, and portions of the back panel 521 and the side panels 523*a*, 523*b* as well as the enlarged portion 585*a* of the first front panel 531*a*, the attachment portion 585*b* of the second front panel 531*b*, the back end flaps 527*a*, and the front end flaps 527*b* can extend at least partially around the interior space 573 of the compartment 505 (FIG. 16). In one embodiment, the proximal portions of the inner flaps 592 can further define the compartment 505 in the interior of the carton 501.

In one embodiment, the articles C, P can be loaded into the compartments 503, 505 to form the package 507 (FIG. 17) similarly as described above in relation to the prior embodiments before the end flaps 527*a*, 528*a*, 527*b*, 528*b*. As shown in FIG. 17, the windows 587, 591 can provide visibility of the articles C, P in the interior spaces 573 of the compartments 503, 505 in the package 507. The carton 501 and/or the package 507 could be otherwise formed without departing from the disclosure.

As shown in FIG. 17, the envelope 601 can be formed from the envelope blank 600 by folding the side attachment flaps 617 over the central panel 611 along the fold lines 619 and folding the cover panel 613 over the central panel 611 and the side attachment flaps 617. The cover panel 613 can be glued or otherwise secured to the side attachment flaps 617. As shown in FIG. 17, the central panel 611, the cover panel 613, and the side attachment flaps 617 can extend around an interior 633 of the envelope 601, and the package 507 can be inserted into the envelope interior 633 through an opening 635 between the end attachment flap 621 and the top edge of the cover panel 613. When the package 507 is fully inserted into the envelope interior 633, the end attachment flap 621 can be folded along the fold line 623 to overlap the cover panel 613. A distal portion of the end attachment flap 621 (e.g., defined by the tear strip 625) can be glued to the cover panel 613 to close the envelope 601 with the package 507 in the envelope interior 633. The envelope 601 could be otherwise formed and/or the package 507 could be otherwise loaded into the envelope 601 without departing from the disclosure.

In one embodiment, the flexibility features 509 of the carton 501 can cooperate with the flexibility features 609 in the envelope 601 (e.g., the score lines 151, 590 in the carton 501 can be at least partially aligned with the score line 627 in the envelope 601 and one or both of the score lines 553 and the lines of perforations 561 in the carton 501 can be at least partially aligned with the scores 629, 631 in the envelope 601). Accordingly, the combination of the package 507 and the envelope 601 can be flexed and/or bent in a similar manner as the package 107 of first embodiment (e.g., for at least partially complying with flexibility standards for United States Postal Service flat-size mailpieces).

In the illustrated embodiment, the envelope 601 can be opened by tearing along the tear strip 625 and folding the remaining proximal portion of the end attachment flap 621 to allow the package 507 to be removed from the envelope interior 633 at the opening 635. The compartments 503, 505 can be separated and the articles C, P can be accessed similarly as described above with respect to the prior embodiments. The envelope 601 and/or the package 507 could be otherwise opened without departing from the disclosure.

Any of the features of the various embodiments of the disclosure can be combined with, replaced by, or otherwise configured with other features of other embodiments of the disclosure without departing from the scope of this disclosure.

Generally, as described herein, liners or bags can be formed from a paper stock material, although various plastic or other liner materials also can be used, and can be lined or coated with a desired material. The constructs, blanks, and/or reinforcing sleeves described herein can be made from a more rigid material such as a clay-coated natural kraft ("CCNK"). Other materials such various card-stock, paper, plastic or other synthetic or natural materials also can be used to form the components of the packages described herein.

In general, the blanks of the present disclosure may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of articles, the carton comprising:

a plurality of panels comprising a back panel, a first front panel positioned opposite to the back panel, a second front panel positioned opposite to the back panel, a first side panel foldably connected to the back panel and the first front panel, and a second side panel foldably connected to the back panel and the second front panel;

a first compartment comprising a first interior space for at least partially receiving at least a first article of the plurality of articles and a second compartment comprising a second interior space for at least partially receiving at least a second article of the plurality of articles, at least a portion of at least the back panel and the first front panel extending at least partially around the first interior space of the first compartment, and at least a portion of at least the back panel and the second front panel extending at least partially around the second interior space of the second compartment; and opening features extending in at least the back panel, the first front panel, and the second front panel, the opening features extending along at least the first compartment and the second compartment for separating the first compartment and the second compartment from a remainder of the carton;

wherein at least a portion of the first side panel extends along the first interior space of the first compartment and at least a portion of the second side panel extends along the second interior space of the second compartment.

2. The carton of claim 1, further comprising a third compartment comprising a third interior space, wherein a portion of each of the back panel, the first side panel, the second side panel, the first front panel, and the second front panel extends at least partially around the third interior space of the third compartment.

3. The carton of claim 1, further comprising a first divider panel foldably connected to the first front panel, a second divider panel foldably connected to the second front panel, a first attachment flap foldably connected to the first divider panel, and a second attachment flap foldably connected to the second divider flap, each of the first attachment flap and the second attachment flap being in an overlapping relationship with the back panel, and the first divider panel and the second divider panel extending along the respective first interior space of the first compartment and second interior space of the second compartment.

4. The carton of claim 3, further comprising a third compartment comprising a third interior space, wherein a third divider panel is foldably connected to the first front panel and the first attachment flap and a fourth divider panel is foldably connected to the second front panel and the second attachment flap, and wherein the third divider panel, the fourth divider panel, and a portion of each of the back panel, the first attachment flap, and the second attachment flap extends at least partially around the third interior space of the third compartment.

5. The carton of claim 1, further comprising a plurality of end flaps respectively foldably connected to respective panels of the plurality of panels, wherein the plurality of end flaps comprises front end flaps foldably connected to the respective first front panel and second front panel and back end flaps foldably connected to the back panel, the front end flaps being in an overlapping relationship with the respective back end flaps to at least partially close respective ends of the first compartment and the second compartment.

6. The carton of claim 1, further comprising a third compartment comprising a third interior space and a plurality of end flaps respectively foldably connected to respective panels of the plurality of panels, wherein the plurality of end flaps comprises front end flaps foldably connected to the first front panel and back end flaps foldably connected to the back panel, the front end flaps being in an overlapping relationship with the respective back end flaps to at least partially close an end of the third compartment.

7. The carton of claim 1, wherein the opening features comprise tear strips extending in the respective first front panel and second front panel along the respective first compartment and second compartment.

8. The carton of claim 1, further comprising a first window and a second window extending in the respective first front panel and second front panel along the respective first compartment and second compartment.

9. The carton of claim 8, further comprising a third compartment comprising a third interior space and a third window extending in the first front panel along the third compartment.

10. The carton of claim 1, further comprising flexibility features extending in at least the back panel, the first front panel, and the second front panel, the flexibility features comprising at least a longitudinal score line and a lateral score line extending in at least the back panel.

11. The carton of claim 10, wherein the plurality of panels further comprises a cover panel at least partially overlapping the first front panel and the second front panel and an end panel foldably connected to the back panel and the cover panel, the longitudinal score line further extends in the end panel and the cover panel, the lateral score line is a first lateral score line, and the flexibility features further comprise a second lateral score line extending in the cover panel, the second lateral score line being at least partially aligned with the first lateral score line and portions of the longitudinal score line extending in the respective cover panel and back panel being at least partially aligned with one another.

12. The carton of claim 1 in combination with an envelope comprising at least a central panel and a cover panel extending at least partially around an envelope interior, the carton being at least partially positioned in the envelope interior.

13. A carton for holding a plurality of articles, the carton comprising:

a plurality of panels comprising a back panel, a first front panel positioned opposite to the back panel, a second front panel positioned opposite to the back panel, and a cover panel at least partially overlapping the first front panel and the second front panel;

a first compartment comprising a first interior space for at least partially receiving at least a first article of the plurality of articles and a second compartment comprising a second interior space for at least partially receiving at least a second article of the plurality of articles, at least a portion of at least the back panel and the first front panel extending at least partially around the first interior space of the first compartment, and at least a portion of at least the back panel and the second front panel extending at least partially around the second interior space of the second compartment; and opening features extending in at least the back panel, the first front panel, and the second front panel, the opening features extending along at least the first compartment and the second compartment for separating the first compartment and the second compartment from a remainder of the carton.

14. The carton of claim 13, wherein the cover panel is a first cover panel and the plurality of panels further comprises a second cover panel at least partially overlapping the first front panel and the second front panel, the first cover panel at least partially overlaps the second cover panel, and a tear strip extends in the first cover panel for at least partially opening the carton.

15. The carton of claim 13, wherein the plurality of panels further comprises an end panel foldably connected to the back panel and the cover panel, the end panel extending along at least one of the first interior space of the first compartment and the second interior space of the second compartment.

16. The carton of claim 13, wherein the cover panel is a first cover panel and the plurality of panels comprises a second cover panel, a first end panel, and a second end panel, the second cover panel at least partially overlaps the first front panel and the second front panel, the first end panel is foldably connected to the back panel and the first cover panel, and the second end panel is foldably connected to the back panel and the second cover panel.

17. The carton of claim 16, further comprising a third compartment comprising a third interior space, wherein a portion of each of the back panel, the first end panel, and the first cover panel extends at least partially around the third interior space of the third compartment, and a portion of the second end panel extends along each of the first interior space of the first compartment and the second interior space of the second compartment.

18. A carton for holding a plurality of articles, the carton comprising:

a plurality of panels comprising a back panel, a first front panel positioned opposite to the back panel, and a second front panel positioned opposite to the back panel;

a first compartment comprising a first interior space for at least partially receiving at least a first article of the plurality of articles and a second compartment comprising a second interior space for at least partially receiving at least a second article of the plurality of articles, at least a portion of at least the back panel and the first front panel extending at least partially around the first interior space of the first compartment, and at least a portion of at least the back panel and the second front panel extending at least partially around the second interior space of the second compartment; and opening features extending in at least the back panel, the first front panel, and the second front panel, the opening features extending along at least the first compartment and the second compartment for separating the first compartment and the second compartment from a remainder of the carton;

wherein the opening features comprise a lateral tear line, a first longitudinal tear line, and a second longitudinal tear line extending in the back panel, portions of the lateral tear line extending along the respective first compartment and second compartment, the first longitudinal tear line extending along the first compartment, and the second longitudinal tear line extending along the second compartment.

19. A blank for forming a carton for holding a plurality of articles, the blank comprising:

a plurality of panels comprising a back panel, a first front panel, a second front panel, a first side panel foldably connected to the back panel and the first front panel, and a second side panel foldably connected to the back panel and the second front panel;

at least a portion of at least the back panel and the first front panel being for extending at least partially around a first interior space of a first compartment when the carton is formed from the blank, the first interior space being for at least partially receiving at least a first article of the plurality of articles when the carton is formed from the blank;

at least a portion of at least the back panel and the second front panel being for extending at least partially around a second interior space of a second compartment when the carton is formed from the blank, and the second interior space being for at least partially receiving at least a second article of the plurality of articles when the carton is formed from the blank; and opening features extending in at least the back panel, the first front panel, and the second front panel, the opening features being for extending along at least the first compartment and the second compartment when the carton is formed from the blank for separating the first compartment and the second compartment from a remainder of the carton formed from the blank;

wherein at least a portion of the first side panel is for extending along the first interior space of the first compartment when the carton is formed from the blank and at least a portion of the second side panel is for extending along the second interior space of the second compartment when the carton is formed from the blank.

20. The blank of claim 19, wherein a portion of each of the back panel, the first side panel, the second side panel, the first front panel, and the second front panel is for extending at least partially around a third interior space of a third compartment when the carton is formed from the blank.

21. The blank of claim 19, further comprising a first divider panel foldably connected to the first front panel, a second divider panel foldably connected to the second front panel, a first attachment flap foldably connected to the first divider panel, and a second attachment flap foldably connected to the second divider flap, wherein each of the first attachment flap and the second attachment flap is for being in an overlapping relationship with the back panel when the carton is formed from the blank, and the first divider panel and the second divider panel are for extending along the respective first interior space of the first compartment and second interior space of the second compartment when the carton is formed from the blank.

22. The blank of claim 21, further comprising a third divider panel and a fourth divider panel, the first divider panel being foldably connected to the first front panel and the first attachment flap, the fourth divider panel being foldably connected to the second front panel and the second attachment flap, wherein the third divider panel, the fourth divider panel, and a portion of each of the back panel, the first attachment flap, and the second attachment flap extends at least partially around a third interior space of a third compartment when the carton is formed from the blank.

23. The blank of claim 19, further comprising a plurality of end flaps respectively foldably connected to respective panels of the plurality of panels, wherein the plurality of end flaps comprises front end flaps foldably connected to the respective first front panel and second front panel and back end flaps foldably connected to the back panel, and the front end flaps are for being in an overlapping relationship with the respective back end flaps to at least partially close respective ends of the first compartment and the second compartment when the carton is formed from the blank.

24. The blank of claim 19, further comprising a plurality of end flaps respectively foldably connected to respective panels of the plurality of panels, wherein the plurality of end flaps comprises front end flaps foldably connected to the first front panel and back end flaps foldably connected to the back panel, and the front end flaps are for being in an overlapping relationship with the respective back end flaps to at least partially close an end of a third compartment when the carton is formed from the blank.

25. The blank of claim 19, wherein the opening features comprise tear strips extending in the respective first front panel and second front panel.

26. The blank of claim 19, further comprising a first window and a second window extending in the respective first front panel and second front panel.

27. The blank of claim 19, further comprising flexibility features extending in at least the back panel, the first front panel, and the second front panel, the flexibility features comprising at least a longitudinal score line and a lateral score line extending in at least the back panel.

28. The blank of claim 27, wherein the plurality of panels further comprises a cover panel and an end panel foldably connected to the back panel and the cover panel, the longitudinal score line further extends in the end panel and the cover panel, the lateral score line is a first lateral score line, and the flexibility features further comprise a second lateral score line extending in the cover panel.

29. The blank of claim 19 in combination with an envelope blank for forming an envelope for at least partially containing the carton formed from the blank, the envelope blank comprising at least a central panel and a cover panel.

30. A blank for forming a carton for holding a plurality of articles, the blank comprising:

a plurality of panels comprising a back panel, a first front panel, a second front panel, and a cover panel for at least partially overlapping the first front panel and the second front panel when the carton is formed from the blank;

at least a portion of at least the back panel and the first front panel being for extending at least partially around a first interior space of a first compartment when the carton is formed from the blank, the first interior space being for at least partially receiving at least a first article of the plurality of articles when the carton is formed from the blank;

at least a portion of at least the back panel and the second front panel being for extending at least partially around a second interior space of a second compartment when the carton is formed from the blank, and the second interior space being for at least partially receiving at least a second article of the plurality of articles when the carton is formed from the blank; and opening features extending in at least the back panel, the first front panel, and the second front panel, the opening features being for extending along at least the first compartment and the second compartment when the carton is formed from the blank for separating the first compartment and the second compartment from a remainder of the carton formed from the blank.

31. The blank of claim 30, wherein the cover panel is a first cover panel, the plurality of panels further comprises a second cover panel for at least partially overlapping the first front panel and the second front panel when the carton is formed from the blank, the first cover panel is for at least partially overlapping the second cover panel when the carton is formed from the blank, and a tear strip extends in the first cover panel for at least partially opening the carton formed from the blank.

32. The blank of claim 30, wherein the plurality of panels further comprises an end panel foldably connected to the back panel and the cover panel, and the end panel is for extending along at least one of the first interior space of the first compartment and the second interior space of the second compartment when the carton is formed from the blank.

33. The blank of claim 30, wherein the cover panel is a first cover panel and the plurality of panels comprises a second cover panel, a first end panel, and a second end panel, the second cover panel is for at least partially overlapping the first front panel and the second front panel when the carton is formed from the blank, the first end panel is foldably connected to the back panel and the first cover panel, and the second end panel is foldably connected to the back panel and the second cover panel.

34. The blank of claim 33, wherein a portion of each of the back panel, the first end panel, and the first cover panel is for extending at least partially around a third interior space of a third compartment when the carton is formed from the blank, and a portion of the second end panel is for extending along each of the first interior space of the first compartment and the second interior space of the second compartment when the carton is formed from the blank.

35. A blank for forming a carton for holding a plurality of articles, the blank comprising:

a plurality of panels comprising a back panel, a first front panel, and a second front panel;

at least a portion of at least the back panel and the first front panel being for extending at least partially around a first interior space of a first compartment when the carton is formed from the blank, the first interior space being for at least partially receiving at least a first article of the plurality of articles when the carton is formed from the blank;

at least a portion of at least the back panel and the second front panel being for extending at least partially around a second interior space of a second compartment when the carton is formed from the blank, and the second interior space being for at least partially receiving at least a second article of the plurality of articles when the carton is formed from the blank; and opening features extending in at least the back panel, the first front panel, and the second front panel, the opening features being for extending along at least the first compartment and the second compartment when the carton is formed from the blank for separating the first compartment and the second compartment from a remainder of the carton formed from the blank;

wherein the opening features comprise a lateral tear line, a first longitudinal tear line, and a second longitudinal tear line extending in the back panel, portions of the lateral tear line are for extending along the respective first compartment and second compartment when the carton is formed from the blank, the first longitudinal tear line is for extending along the first compartment when the carton is formed from the blank, and the second longitudinal tear line is for extending along the second compartment when the carton is formed from the blank.

36. A method of forming a carton for holding a plurality of articles, the method comprising:

obtaining a blank comprising a plurality of panels comprising a back panel, a first front panel, a second front panel, and, a first side panel foldably connected to the back panel and the first front panel, and a second side panel foldably connected to the back panel and the second front panel, the blank further comprising opening features extending in at least the back panel, the first front panel, and the second front panel;

positioning the plurality of panels to form at least a first compartment and a second compartment, the first compartment comprising a first interior space for at least partially receiving at least a first article of the plurality of articles and the second compartment comprising a second interior space for at least partially receiving at least a second article of the plurality of articles, wherein at least a portion of at least the back panel and the first front panel extends at least partially around the first interior space of the first compartment, and at least a portion of at least the back panel and the second front panel extends at least partially around the second interior space of the second compartment;

wherein the opening features extend along at least the first compartment and the second compartment for separating the first compartment and the second compartment from a remainder of the carton;

wherein the positioning the plurality of panels further comprises positioning at least a portion of the first side panel to extend along the first interior space of the first compartment and at least a portion of the second side panel to extend along the second interior space of the second compartment.

37. The method of claim 36, further comprising a first divider panel foldably connected to the first front panel, a second divider panel foldably connected to the second front panel, a first attachment flap foldably connected to the first divider panel, and a second attachment flap foldably connected to the second divider flap, wherein the positioning the plurality of panels to form at least the first compartment and the second compartment comprises positioning each of the first attachment flap and the second attachment flap in an overlapping relationship with the back panel so that the first divider panel and the second divider panel extend along the respective first interior space of the first compartment and second interior space of the second compartment.

38. The method of claim 36, wherein the plurality of panels further comprises a first cover panel and a second cover panel, a tear strip extends in the first cover panel for at least partially opening the carton, and the method further comprises the positioning the second cover panel to at least partially overlap the first front panel and the second front panel and positioning the first cover panel to at least partially overlap the first front panel, the second front panel, and the second cover panel.

39. The method of claim 36, further comprising flexibility features extending in at least the back panel, the first front panel, and the second front panel, the flexibility features comprising at least a longitudinal score line and a lateral score line extending in at least the back panel.

40. The method of claim 36, further comprising obtaining an envelope blank comprising at least a central panel and a cover panel, forming an envelope by positioning at least the central panel and the cover panel to extend at least partially around an envelope interior, and inserting the carton at least partially in the envelope interior.

41. A method of forming a carton for holding a plurality of articles, the method comprising:

obtaining a blank comprising a plurality of panels comprising a back panel, a first front panel, a second front panel, and a cover panel, the blank further comprising opening features extending in at least the back panel, the first front panel, and the second front panel;

positioning the plurality of panels to form at least a first compartment and a second compartment, the first compartment comprising a first interior space for at least partially receiving at least a first article of the plurality of articles and the second compartment comprising a second interior space for at least partially receiving at least a second article of the plurality of articles, wherein at least a portion of at least the back panel and the first front panel extends at least partially around the first interior space of the first compartment, and at least a portion of at least the back panel and the second front panel extends at least partially around the second interior space of the second compartment; and positioning the cover panel to at least partially overlap the first front panel and the second front panel;

wherein the opening features extend along at least the first compartment and the second compartment for separating the first compartment and the second compartment from a remainder of the carton.

* * * * *